US009549255B2

(12) United States Patent
Katagiri

(10) Patent No.: US 9,549,255 B2
(45) Date of Patent: Jan. 17, 2017

(54) SOUND PICKUP APPARATUS AND METHOD FOR PICKING UP SOUND

(71) Applicant: Oki Electric Industry Co., Ltd., Tokyo (JP)

(72) Inventor: Kazuhiro Katagiri, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/236,375

(22) Filed: Aug. 12, 2016

(65) Prior Publication Data

US 2016/0353203 A1 Dec. 1, 2016

Related U.S. Application Data

(62) Division of application No. 14/309,048, filed on Jun. 19, 2014, now Pat. No. 9,445,194.

(30) Foreign Application Priority Data

Aug. 30, 2013 (JP) ..... 2013-179886

(51) Int. Cl.
*H04R 3/00* (2006.01)
*H04R 1/32* (2006.01)

(52) U.S. Cl.
CPC ..... *H04R 3/005* (2013.01); *H04R 1/326* (2013.01); *H04R 2201/401* (2013.01); *H04R 2430/03* (2013.01); *H04R 2430/23* (2013.01)

(58) Field of Classification Search
CPC ..... H04R 3/005; H04R 1/326; H04R 2430/03; H04R 2430/23; H04R 1/20; H04R 1/406; H04R 2201/401; H04R 2203/00; G10L 21/00
See application file for complete search history.

(56) References Cited

U.S. PATENT DOCUMENTS

| | | | | |
|---|---|---|---|---|
| 5,793,875 | A | 8/1998 | Lehr et al. | |
| 9,445,194 | B2 * | 9/2016 | Katagiri | H04R 1/406 |
| 2008/0317259 | A1 | 12/2008 | Zhang et al. | |
| 2009/0323977 | A1 | 12/2009 | Kobayashi et al. | |
| 2011/0142252 | A1 | 6/2011 | Morito et al. | |
| 2011/0200205 | A1 | 8/2011 | Tokuda | |

FOREIGN PATENT DOCUMENTS

JP 2006-197552 A 7/2006

OTHER PUBLICATIONS

Futoshi Asano, "Acoustical Technology Series 16: Array signal processing for acoustics: localization, tracking and separation of sound sources" edited by the Acoustical Society of Japan, Corona Publishing Co., Ltd, Feb. 25, 2011.

* cited by examiner

*Primary Examiner* — Andrew L Sniezek
(74) *Attorney, Agent, or Firm* — Rabin & Berdo, P. C.

(57) ABSTRACT

A sound pickup apparatus and method form a bidirectionality and a unidirectionality based on sound signals picked up by microphones arranged at vertices of a triangle. A target sound is extracted by performing a spectral subtraction operation and, with respect to each frequency, a ratio of amplitude spectra of beamformer outputs between outputs is calculated for each microphone array of a directionality forming unit. A mode or median of the calculated ratio of amplitude spectra is set as a correction coefficient which corrects power of beamformer outputs for each of the microphone arrays and a target area sound is extracted.

4 Claims, 10 Drawing Sheets

SOUND PICKUP APPARATUS AND METHOD FOR PICKING UP SOUND

CROSS REFERENCE TO RELATED APPLICATION(S)

This is a Divisional of U.S. application Ser. No. 14/309,048, filed on Jun. 19, 2014, and allowed on May 13, 2016, now U.S. Pat. No. 9,445,194 the subject matter of which is incorporated herein by reference. The parent application Ser. No. 14/309,048 is based upon and claims benefit of priority from Japanese Patent Application No. 2013-179886, filed on Aug. 30, 2013, the entire contents of which are incorporated herein by reference.

BACKGROUND

The present invention relates to a sound source separating apparatus, a sound source separating program, a sound pickup apparatus, and a sound pickup program, and can be applied to a sound source separating apparatus, a sound source separating program, a sound pickup apparatus, and a sound pickup program that separate and pick up a sound source only in a specific direction in an environment in which a plurality of sound sources are present, for example.

As a technique to separate and pick up a sound (hereinafter, things including a voice and a sound, for example, are expressed as a sound) only in a specific direction in an environment in which a plurality of sound sources are present, there is a beamformer (hereinafter also referred to as a BF) employing a microphone array. The beamformer is a technique to form directionality by use of a temporal difference between signals which reach respective microphones (see Futoshi Asano, "Acoustical Technology Series 16: Array signal processing for acoustics: localization, tracking and separation of sound sources, edited by the Acoustical Society of Japan, Corona Publishing Co., Ltd, Feb. 25, 2011). Beamformers are broadly classified into two kinds: an addition type and a subtraction type. In particular, the subtraction type BF has an advantage in that the subtraction type BF can form directionality with a smaller number of microphones than the addition type BF.

FIG. 2 is a block diagram showing a configuration of the subtraction type BF in which the number of microphones is two. In the subtraction type BF, first, a sound present in a target direction (hereinafter referred to as a target sound) reaches each of microphones 1 and 2, and a delayer 91 calculates a temporal difference between signals that have reached the microphones 1 and 2. Then, by adding a delay to a signal from any one of the microphones, a phase of the target sound is adjusted.

The temporal difference is calculated using the following formula (1). Here, d represents a distance between the microphones, c represents the sound speed, and $\tau_L$ represents a delay. Further, $\theta_L$ represents an angle between the target direction and a perpendicular direction with respect to a straight line connecting the microphones 1 and 2.

$$\tau_L=(d \sin \theta_L)/c \tag{1}$$

Here, in a case where a dead angle direction is present in the direction of the microphone 1 with respect to the intermediate point between the microphones 1 and 2, a delay process is performed on an input signal $x_1(t)$ of the microphone 1. Then, a subtracter 92 performs a process in accordance with a formula (2).

$$\alpha(t)=x_2(t)-x_1(t-\tau_L) \tag{2}$$

The subtraction process can be performed similarly in a frequency region, in which case the formula (2) is changed as follows.

$$A(\omega)=X_2(\omega)-e^{-j\omega\tau_L}X_1(\omega) \tag{3}$$

Here, in a case where $\theta_L=\pm\pi/2$, the formed directionality becomes a cardioid unidirectionality as shown in FIG. 3A, and in a case where $\theta_L=0$ or $\pi$, the formed directionality becomes an eight-shaped bidirectionality as shown in FIG. 3B. Here, a filter that forms the unidirectionality from the input signal is referred to as a unidirectional filter and a filter that forms the bidirectionality is referred to as a bidirectional filter.

Further, by use of a spectral subtraction (hereinafter also referred to as an SS), a strong directionality can be formed in the dead angle direction of the bidirectionality. The directionality is formed by use of the SS in accordance with the following formula (4).

$$|Y(\omega)|=|X_1(\omega)|-\beta|A(\omega)| \tag{4}$$

Although the input signal $X_1$ of the microphone 1 is used in the formula (4), the same effects can be obtained by using an input signal $X_2$ of the microphone 2. Here, $\beta$ is a coefficient for adjusting the intensity of the SS. When the value becomes negative in subtraction, a flooring process is performed to replace the value by 0 or a value that is smaller than the original value. This technique makes it possible to emphasize the target sound by extracting a sound that is present in directions other than the target direction (hereinafter referred to as a non-target sound) through the bidirectional filter and by subtracting an amplitude spectrum of the extracted non-target sound from an amplitude spectrum of the input signal.

SUMMARY

In order to actually use a sound source separating apparatus for a telephone call, voice recognition, and the like, however, it is necessary to form directionality only in one direction and to have a strong directionality. Although a unidirectional filter can make a dead angle in the direction opposite to the target direction as shown in FIG. 3A, unfortunately, the directionality in the target direction might become weak. Further, although a beamformer using the spectrum subtraction (SS) can obtain a strong directionality in the target direction, unfortunately, directionality is also formed in the same manner in the direction opposite to the target direction as shown in FIG. 3B. Accordingly, JP 2006-197552A proposes a technique to form unidirectionalities and bidirectionalities in various directions by increasing the number of microphones, and to form a strong directionality only in the target direction by use of outputs from the plurality of directional filters.

The technique disclosed in JP 2006-197552A, however, compares the outputs from the respective directional filters including the target sound according to each frequency and determines whether there is a target sound component or not, thereby separating a sound; thus, in a case where the determination of the target sound component fails, the sound quality of the target sound after the separation might degrade. Further, since masking is performed in which the component that is determined to be a non-target sound is made to 0 in separation, an increase in the non-target sound rapidly degrades the separation performance.

Further, in a case of picking up only a sound that is present within a specific area (hereinafter referred to as a target area sound), the use of the subtraction type BF alone might also pick up a sound source that is present in the periphery of the area (hereinafter referred to as a non-target area sound). Accordingly, the inventor of the present application proposes, in a reference document (Japanese Application Number 2012-217315), a technique to pick up the target area sound by forming directionalities toward a target area from different directions by use of a plurality of microphone arrays and by crossing the directionalities in the target area.

However, in an environment in which reverberation is strong, in particular, in a case where a primary reflection is large, the sound pickup performance might degrade. The technique disclosed in the reference document assumes that a component that is commonly included in the directionalities of the respective microphone arrays is only the target area sound, and that the non-target area sound components are different. Thus, in a case where a sound in an area that is located at a corner of a room or beside a wall is picked up and some of the non-target area sounds are reflected by the wall and are mixed in the directionalities of the respective microphone arrays at the same time, the non-target area sound components are regarded as the target area sound component and are extracted without being suppressed.

Accordingly, a sound source separating apparatus and program are required that can form a sharp directionality only in a target direction and can extract a target sound with little degradation in sound quality. Further, a sound pickup apparatus and program are required that can form directionality only in a forward direction of a target area and can suppress an influence of reverberation and can increase an SN ratio by picking up a sound in an area.

In order to solve one or more of the above problems, according to a first aspect of the present invention, there is provided a sound source separating apparatus including a bidirectionality forming unit configured to form a bidirectionality having a dead angle in a target direction by use of a sound signal picked up by two microphones which are located to be horizontal with respect to the target direction, among three microphones disposed at vertexes of an isosceles right triangle, a unidirectionality forming unit configured to form a unidirectionality having a dead angle in the target direction by use of a sound signal picked up by two microphones which are located in a same direction as the target direction, among the three microphones, and a target sound extracting unit configured to extract a target sound by performing a spectral subtraction of all outputs from the bidirectionality forming unit and the unidirectionality forming unit from either one of sound signals picked up by the two microphones located to be horizontal with respect to the target direction or a signal obtained by averaged sound signals picked up by the two microphones.

According to a second aspect of the present invention, there is provided a sound source separating apparatus including a bidirectionality forming unit configured to form a bidirectionality having a dead angle in a target direction by use of a sound signal picked up by two microphones which are located to be horizontal with respect to the target direction, among three microphones disposed at vertexes of a regular triangle, a unidirectionality forming unit configured to form two unidirectionalities having dead angles of +60° and −60° with respect to the target direction by use of a sound signal picked up by a combination of two microphones which are located at angles of +60° and −60° with respect to the target direction, among the three microphones, and a target sound extracting unit configured to extract a target sound by performing a spectral subtraction of all outputs from the bidirectionality forming unit and the unidirectionality forming unit from either one of sound signals picked up by the two microphones located to be horizontal with respect to the target direction or a signal obtained by averaged sound signals picked up by the two microphones.

According to a third aspect of the present invention, there is provided a sound source separating apparatus including a bidirectionality forming unit configured to form a bidirectionality having a dead angle in a target direction by use of a sound signal picked up by two microphones which are located to be horizontal with respect to the target direction, among three microphones disposed at vertexes of a regular triangle, a unidirectionality forming unit configured to form a unidirectionality having a dead angle in the target direction by use of a signal obtained by averaged sound signals picked up by two microphones which are located to be horizontal with respect to the target direction and a sound signal picked up by the other microphone, among the three microphones, and a target sound extracting unit configured to extract a target sound by performing a spectral subtraction of all outputs from the bidirectionality forming unit and the unidirectionality forming unit from either one of sound signals picked up by the two microphones located to be horizontal with respect to the target direction or a signal obtained by averaged sound signals picked up by the two microphones.

According to a fourth aspect of the present invention, there is provided a sound source separating program for causing a computer to function as a bidirectionality forming unit configured to form a bidirectionality having a dead angle in a target direction by use of a sound signal picked up by two microphones which are located to be horizontal with respect to the target direction, among three microphones disposed at vertexes of an isosceles right triangle, a unidirectionality forming unit configured to form a unidirectionality having a dead angle in the target direction by use of a sound signal picked up by two microphones which are located in a same direction as the target direction, among the three microphones, and a target sound extracting unit configured to extract a target sound by performing a spectral subtraction of all outputs from the bidirectionality forming unit and the unidirectionality forming unit from either one of sound signals picked up by the two microphones located to be horizontal with respect to the target direction or a signal obtained by averaged sound signals picked up by the two microphones.

According to one embodiment of the invention, a sound pickup apparatus includes a plurality of microphone arrays each including three microphones disposed at vertexes of an isosceles right triangle or a regular triangle. A directionality forming unit is configured to form directionality, for each of the microphone arrays, only in a forward direction of each of the microphone arrays with respect to a target area by use of beamformers, for each output from each of the microphone arrays. The directionality forming unit includes a bidirectionality forming unit configured to form a bidirectionality having a dead angle in a target direction by use of a sound signal picked up by two microphones which are located to be horizontal with respect to the target direction, among three microphones disposed at vertexes of an isosceles right triangle. The directionality forming unit further includes a unidirectionality forming unit and a target sound extracting unit. The unidirectionality forming unit is configured to form a unidirectionality having a dead angle in the target direction by use of a sound signal picked up by two microphones which are located in a same direction as the target direction, among the three microphones. The target sound extracting unit is configured to extract a target sound by performing a spectral subtraction of all outputs from the bidirectionality forming unit and the unidirectionality forming unit from either one of sound signals picked up by the two microphones located to be horizontal with respect to the target direction or a signal obtained by averaged sound signals picked up by the two microphones. The sound pickup apparatus further includes a power correction coefficient calculating unit configured to calculate, with respect to each frequency, a ratio of amplitude spectra of beamformer outputs between outputs for each of the microphone arrays from the directionality forming unit and set a mode or a median of the calculated ratio of amplitude spectra as a correction coefficient which corrects power of beamformer outputs for each of the microphone arrays. A target area sound extracting unit is configured to extract a target area sound by performing the following processes in sequence: correcting a beamformer output from each of the microphone arrays from the directionality forming unit by use of the correction coefficient calculated by the power correction coefficient calculating unit, performing a spectral subtraction of the beamformer output from each of the microphone arrays, the beamformer output being obtained by the correction, to extract a non-target area sound which is present in the target area direction when seen from each of the microphone arrays, and performing a spectral subtraction of the extracted non-target area sound from the beamformer output from each of the microphone arrays from the directionality forming unit.

According to one embodiment, the sound pickup apparatus further includes a spatial coordinate data holding unit configured to hold position information of the target area, each of the microphone arrays, and the microphones included in each of the microphone arrays. An area acquiring unit is configured to acquire information related to selected one or more target areas. An area switching unit is configured to perform the following: acquire, on the basis of information related to the one or more target areas from the area acquiring unit, the position information of the target area, each of the microphone arrays, and the microphones included in each of the microphone arrays from the spatial coordinate data holding unit, determine combination of the microphone arrays for forming directionality toward the selected one or more target areas and combination of the microphones which form a bidirectionality and a unidirectionality in the microphone arrays, and control a signal to be input to the directionality forming unit.

According to one embodiment, the sound pickup apparatus further includes a delay correcting unit configured to perform a correction process that absorbs a difference in propagation delay times of the target area sound to the microphone arrays between outputs of the microphone arrays from the directionality forming unit.

According to one embodiment of the invention, a method of picking up sound in a computer system including a plurality of microphone arrays each including three microphones disposed at vertexes of a triangle, includes forming, by a directionality forming unit, directionality only in a forward direction of each of the microphone arrays with respect to a target area by use of beamformers for each output from each of the microphone arrays. The method further includes forming, by the bidirectionally forming unit, a bidirectionality having a dead angle in a target direction by use of a sound signal picked up by two microphones which are located to be horizontal with respect to the target direction, among three microphones disposed at vertexes of an isosceles right triangle. The method further includes forming, by a unidirectionality forming unit, a unidirectionality having a dead angle in the target direction by use of a sound signal picked up by two microphones which are located in a same direction as the target direction, among the three microphones. A target sound is extracted by performing a spectral subtraction of all outputs from the bidirectionality forming unit and the unidirectionality forming unit from either one of sound signals picked up by the two microphones located to be horizontal with respect to the target direction or a signal obtained by averaged sound signals picked up by the two microphones. A ratio of amplitude spectra of beamformer outputs between outputs is calculated for each of the microphone arrays from the directionality forming unit. A mode or a median of the calculated ratio of amplitude spectra is set as a correction coefficient which corrects power of beamformer outputs for each of the microphone arrays. A target area sound is extracted by performing the following processes in sequence: correcting a beamformer output from each of the microphone arrays from the directionality forming unit by use of the correction coefficient calculated by the power correction coefficient calculating unit, performing a spectral subtraction of the beamformer output from each of the microphone arrays, the beamformer output being obtained by the correction, to extract a non-target area sound which is present in the target area direction when seen from each of the microphone arrays, and performing a spectral subtraction of the extracted non-target area sound from the beamformer output from each of the microphone arrays from the directionality forming unit.

According to one or more of the embodiments of the present invention, it is possible to form a sharp directionality only in a target direction and extract a target sound with little degradation in sound quality. Further, it is possible to form directionality only in a forward direction of a target area, and suppress an influence of reverberation and increase an SN ratio by picking up a sound in an area.

DETAILED DESCRIPTION OF THE EMBODIMENT(S)

Figure 1:
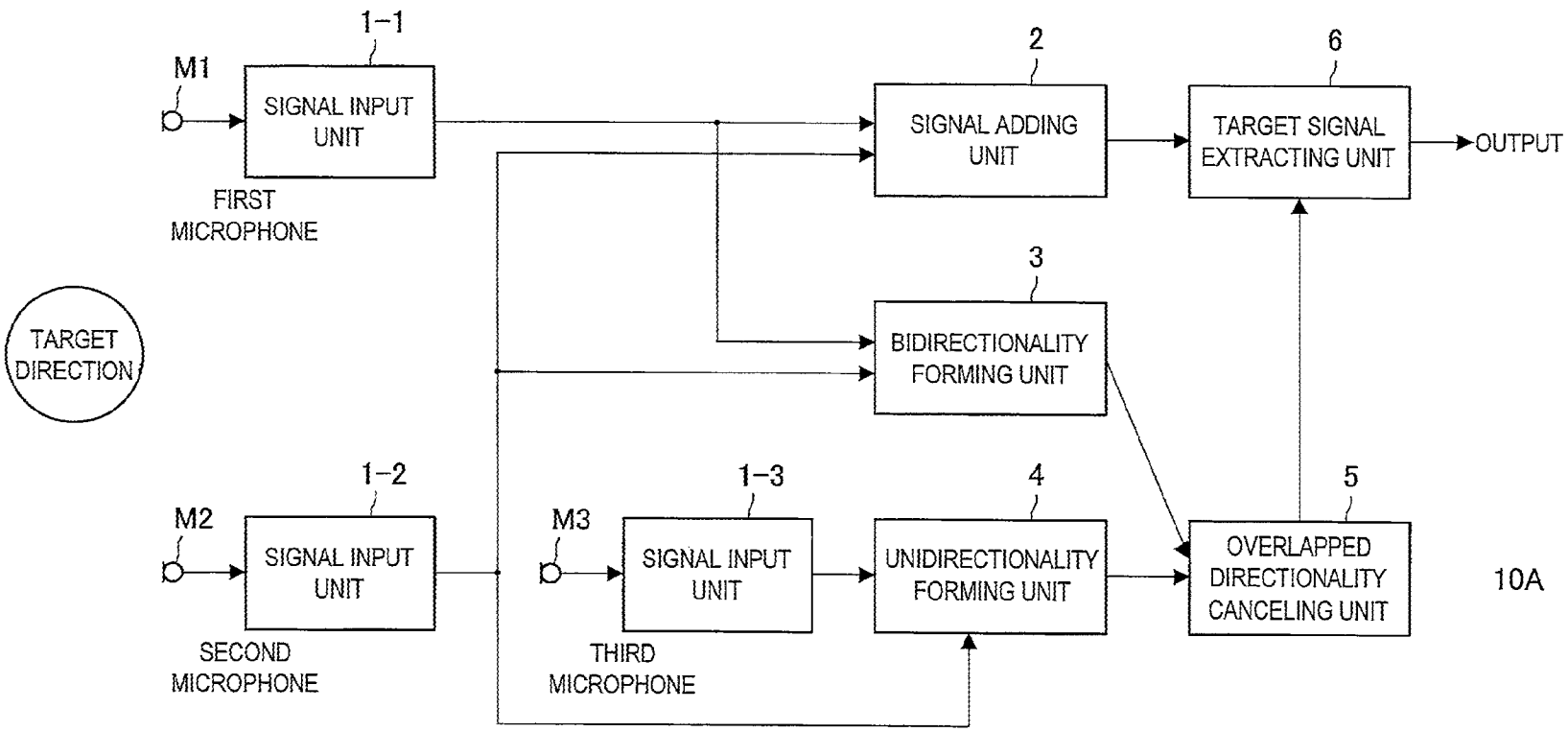
FIG. 1 is a block diagram showing a configuration of a sound source separating apparatus according to a first embodiment.
Figure 2:
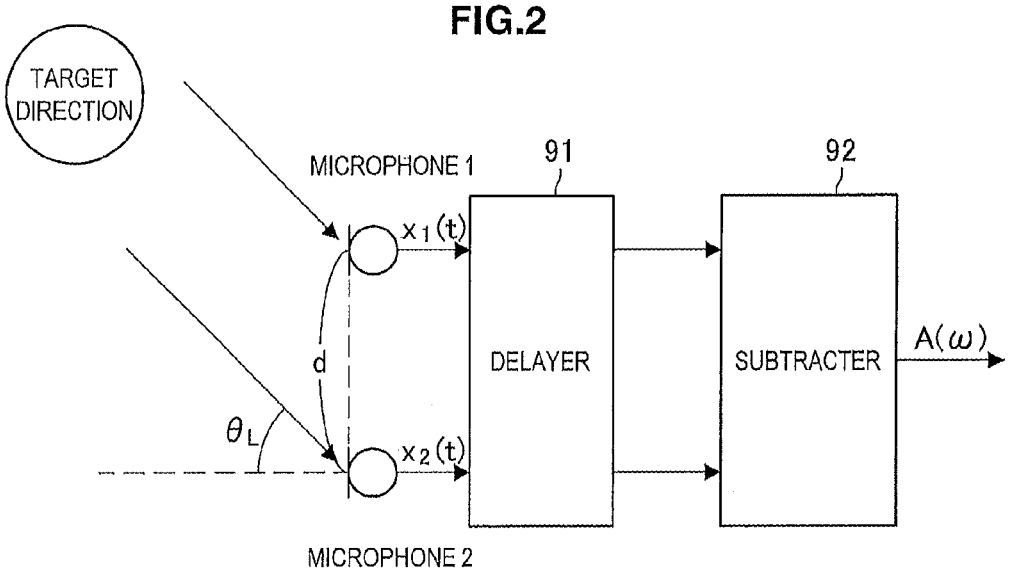
FIG. 2 is a block diagram showing a configuration of a subtraction type beamformer in which the number of microphones is two.
Figure 3:
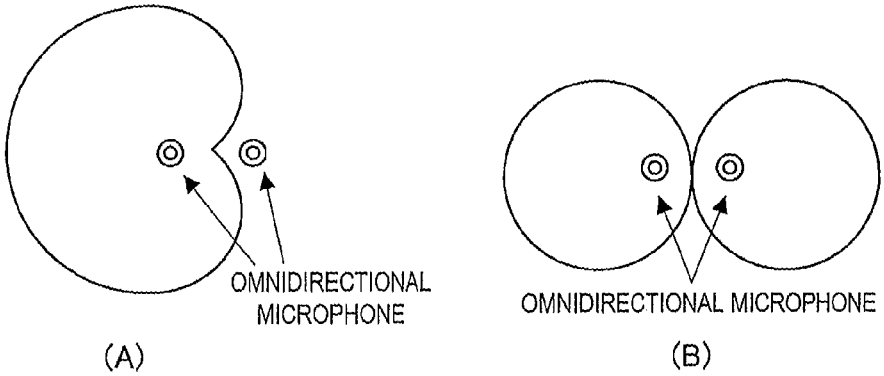
FIGS. 3A and 3B show directional characteristics formed by a subtraction type beamformer by use of two microphones.

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted.

(A) Description of Technical Idea of Embodiments of the Present Invention

First, a technical idea of a sound source separating apparatus and program according to embodiments of the present invention will be described below.

In embodiments of the present invention, a bidirectionality and a unidirectionality are formed by use of three omnidirectional microphones, and perform a spectral subtraction (SS) of outputs from the respective directional filters from input signals, thereby forming a sharp directionality only in a target direction.

Figure 4:
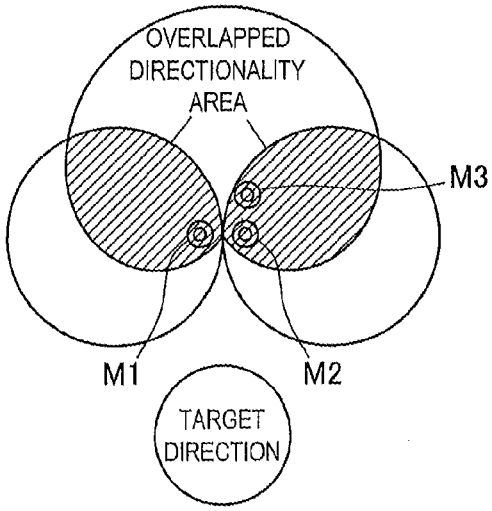
FIG. 4 shows an example of directional characteristics formed by respective directional filters according to embodiments of the present invention.

FIG. 4 shows an example of directional characteristics formed by the respective directional filters according to embodiments of the present invention.

Here, for example, two microphones are disposed to be horizontal with respect to the target direction, and are called a first microphone M1 and a second microphone M2. Further, a third microphone M3 is disposed on a straight line that intersects with a straight line connecting the first microphone M1 and the second microphone M2 and passes through any one of the first microphone M1 and the second microphone M2 (here, the second microphone M2). In this case, the distance between the third microphone M3 and the second microphone M2 is equal to the distance between the first microphone M1 and the second microphone M2. That is, the three microphones M1, M2, and M3 are located to be the vertexes of an isosceles right triangle.

First, signals from the first microphone M1 and the second microphone M2 are input to the bidirectional filter. Further, signals from the second microphone M2 and the third microphone M3 are input to the unidirectional filter having a dead angle toward the target direction.

In this manner, as shown in FIG. 4, it is found that the two directionalities each have a dead angle in the target direction. An output from the bidirectional filter becomes a non-target sound that is present in the left and right direction of the target direction, and an output from the unidirectional filter becomes a non-target sound that is present in a backward direction of the target direction. The use of these two directional filters enables extraction of all the non-target sounds that are present in directions other than the target direction. Finally, an SS of all the outputs from the respective directional filters from an input signal is performed to extract the target sound. Here, the target input signal is an input signal to the first microphone M1 or the second microphone M2, or a signal that is obtained by averaged input signals to the first microphone M1 and the second microphone M2.

In the above technique, the SS is performed by use of two output signals: an output signal from the bidirectional filter and an output signal from the unidirectional filter. As shown in a shaded area in FIG. 4, part of the bidirectionality overlaps with part of the unidirectionality, so that in a simple SS, the overlapped area is subtracted twice. The SS is a technique to extract the target sound by use of a nature called sparsity, with which individual sound components are unlikely to overlap in a frequency domain.

However, whether or not a certain sound component is present alone in a specific frequency depends on the number of sound sources and a frequency resolution. Thus, a situation can be considered where a plurality of sound components are present in the same frequency. Plural times of SS in such a situation might degrade the sound quality because the target sound component would be reduced every time the subtraction is performed.

Accordingly, in embodiments of the present invention, the area where the bidirectionality overlaps with the unidirectionality is canceled prior to the SS. When an amplitude spectrum of the non-target sound extracted by the unidirectional filter is subtracted from an amplitude spectrum of the non-target sound extracted by the bidirectional filter, among the non-target sound components extracted by the bidirectional filter, a component that is commonly included in the non-target sound component extracted by the unidirectional filter is canceled. After that, an SS of the non-target sound component extracted by the unidirectional filter and of the non-target sound extracted by the bidirectional filter from which the overlapped component is canceled from the input signal is performed. Thus, too much subtraction of the target sound component is not caused and the sound quality of the target sound can be prevented from degrading.

(B) First Embodiment

A first embodiment of a sound source separating apparatus and program according to an embodiment of the present invention will be described below in detail with reference to appended drawings.

(B-1) Configuration of the First Embodiment

FIG. 1 is a block diagram showing a configuration of a sound source separating apparatus 10A according to the first embodiment. Portions shown in FIG. 1 other than microphones may be configured by connecting various circuits in a hardware manner, or may be configured to execute corresponding functions by causing a general device or unit including a CPU, ROM, RAM, and the like to execute a predetermined program. In a case of employing either configuration method, the functions thereof can be expressed as FIG. 1.

In FIG. 1, the sound source separating apparatus 10A according to the first embodiment includes a first microphone M1, a second microphone M2, a third microphone M3, signal input units 1-1, 1-2, and 1-3, a signal adding unit 2, a bidirectionality forming unit 3, a unidirectionality forming unit 4, an overlapped directionality canceling unit 5, and a target signal extracting unit 6.

The first microphone M1, the second microphone M2, and the third microphone M3 are each an omnidirectional microphone.

The first microphone M1 and the second microphone M2 are disposed to be horizontal with respect to the target direction. The third microphone M3 is disposed to be present on the same plane as the first microphone M1 and the second microphone M2, to intersect with a straight line connecting the first microphone M1 and the second microphone M2, and to be on a straight line passing through the second microphone M2.

In this case, the distance between the third microphone M3 and the second microphone M2 is set to be equal to the distance between the first microphone M1 and the second microphone M2. Thus, the first microphone M1, the second microphone M2, and the third microphone M3 are located at the vertexes of an isosceles right triangle.

Note that the first microphone M1, the second microphone M2, and the third microphone M3 are disposed at the vertexes of an isosceles right triangle on the same plane in a space.

The signal input unit 1-1 is connected to the signal adding unit 2 and the bidirectionality forming unit 3, inputs a sound signal (things including a voice signal and a sound signal) picked up by the first microphone M1 by converting the sound signal from an analog signal into a digital signal, and outputs the sound signal to the signal adding unit 2 and the bidirectionality forming unit 3.

The signal input unit 1-2 is connected to the signal adding unit 2, the bidirectionality forming unit 3, and the unidirectionality forming unit 4, inputs a sound signal picked up by the second microphone M2 by converting the sound signal from an analog signal into a digital signal, and outputs the sound signal to the signal adding unit 2, the bidirectionality forming unit 3, and the unidirectionality forming unit 4.

The signal input unit 1-3 is connected to the unidirectionality forming unit 4, inputs a sound signal (voice signal, sound signal) picked up by the third microphone M3 by converting the sound signal from an analog signal into a digital signal, and outputs the sound signal to the unidirectionality forming unit 4.

In FIG. 1, in order to convert the input signal from a time domain into a frequency domain, the signal input units 1-1, 1-2, and 1-3 each perform, for example, fast Fourier transform.

The signal adding unit 2 adds signals output from the signal input unit 1-1 and the signal input unit 1-2, multiplies the power of the added signal by ½, and outputs the multiplied signal to the target signal extracting unit 6. An output signal from the signal adding unit 2 becomes an input signal when the spectral subtraction (SS) is performed in the target signal extracting unit 6. In the first embodiment, a case is shown in which a signal obtained by averaged sound signals from the first microphone M1 and the second microphone M2 by the signal adding unit 2 is output to the target signal extracting unit 6; however, either of the signals from the first microphone M1 or the second microphone M2 may be output to the target signal extracting unit 6.

The bidirectionality forming unit 3 is a bidirectional filter that forms a bidirectionality having a dead angle in the target direction by use of a beamformer (BF) with respect to the outputs (digital signals) from the signal input unit 1-1 and the signal input unit 1-2, and outputs the formed bidirectionality to the overlapped directionality canceling unit 5.

The unidirectionality forming unit 4 is a unidirectional filter that forms a unidirectionality having a dead angle in the target direction by use of the beamformers with respect to the outputs (digital signals) from the signal input unit 1-2 and the signal input unit 1-3, and outputs the formed unidirectionality to the overlapped directionality canceling unit 5.

The overlapped directionality canceling unit 5 cancels, in order to cancel the overlapped directionality area of the bidirectionality and the unidirectionality prior to the spectral subtraction (SS) performed in the target signal extracting unit 6, a signal component that is commonly included in the output signal from the bidirectionality forming unit 3 and the output signal from the unidirectionality forming unit 4.

The target signal extracting unit 6 is connected to the signal adding unit 2 and the overlapped directionality canceling unit 5, and extracts the target sound by performing the spectral subtraction of the output signal from the overlapped directionality canceling unit 5 from an input signal which is a signal from the signal adding unit 2.

In a process for extracting the target sound, all the outputs are expected to be expressed in a frequency domain. Therefore, as described above, the signal input units 1-1, 1-2, and 1-3 each include a conversion unit that converts a signal in a time domain into a signal in a frequency domain.

(B-2) Operation in the First Embodiment

Next, an operation in the sound source separating apparatus 10A according to the first embodiment will be described.

The first microphone M1, the second microphone M2, and the third microphone M3 are disposed at the vertexes of an isosceles right triangle. Let us assume that the interval between the first microphone M1 and the second microphone M2 and the interval between the second microphone M2 and the third microphone M3 are each 3 cm, for example.

A sound (voice and sound) emitted from a target sound source is picked up (captured) by the first microphone M1, the second microphone M2, and the third microphone M3.

A sound signal (analog signal) captured by the first microphone M1 is converted into a digital signal by the signal input unit 1-1, further converted by the signal input unit 1-1 by use of fast Fourier transformation, for example, from a time domain into a frequency domain, and given to the signal adding unit 2 and the bidirectionality forming unit 3.

Further, a sound signal (analog signal) captured by the second microphone M2 is converted into a digital signal by the signal input unit 1-2, further converted by the signal input unit 1-2 by use of fast Fourier transformation, for example, from a time domain into a frequency domain, and given to the signal adding unit 2, the bidirectionality forming unit 3, and the unidirectionality forming unit 4.

Further, a sound signal (analog signal) captured by the third microphone M3 is converted into a digital signal by the signal input unit 1-3, further converted by the signal input unit 1-3 by use of fast Fourier transformation, for example, from a time domain into a frequency domain, and given to the unidirectionality forming unit 4.

In the signal adding unit 2, the output signal from the signal input unit 1-1 and the output signal from the signal input unit 1-2, which have the same time axis, are added, and the power of the added signal is multiplied by ½, so that the target sound component is emphasized.

In the bidirectionality forming unit 3, in accordance with the formula (1) in which $\theta_L=0$, on the basis of a distance d (e.g., 3 cm) between the first microphone M1 and the second microphone M2, a temporal difference between a signal that has reached the first microphone M1 and a signal that has reached the second microphone M2 is calculated. Further, in the bidirectionality forming unit 3, in accordance with the formula (3), on the basis of the output signal in the frequency domain from the signal input unit 1-1 and the output signal in the frequency domain from the signal input unit 1-2, the bidirectionality having a dead angle in the target direction is formed.

That is, as shown in FIG. 4, the bidirectionality formed by the bidirectionality forming unit 3 becomes a non-target sound that is present in a straight line direction (the left and right direction in FIG. 4) connecting the first microphone M1 and the second microphone M2 with respect to the target direction.

In the unidirectionality forming unit 4, in accordance with the formula (1) in which $\theta_L=-\pi/2$, on the basis of a distance d (e.g., 3 cm) between the second microphone M2 and the third microphone M3, a temporal difference between a signal that has reached the second microphone M2 and a signal that has reached the third microphone M3 is calculated. Further, in the unidirectionality forming unit 4, in accordance with the formula (3), on the basis of the output signal in the frequency domain from the signal input unit 1-2 and the output signal in the frequency domain from the signal input unit 1-3, the unidirectionality having a dead angle in the target direction is formed.

That is, as shown in FIG. 4, the unidirectionality formed by the unidirectionality forming unit 4 becomes a non-target sound that is present in a backward direction of the target direction (that is, the opposite direction to the target direction).

In the overlapped directionality canceling unit 5, a signal component that is commonly included in an amplitude spectrum $N_{BD}$ of an output from the bidirectionality forming unit 3 and an amplitude spectrum $N_{UD}$ of an output from the unidirectionality forming unit 4 is canceled.

Here, the overlapped directionality canceling unit 5 cancels the overlapped signal component in accordance with a formula (5).

$$N_{UD1} = \begin{cases} N_{UD} - N_{BD} \\ 0 \text{ if } N_{UD1} < 0 \end{cases} \tag{5}$$

Here, $N_{UD1}$ is an amplitude spectrum of an output signal from which the overlapped component of $N_{UD}$ and $N_{BD}$ is canceled.

In a case where $N_{UD1}$ becomes negative as a result of the subtraction of the overlapped signal component, performed by the overlapped directionality canceling unit 5, the overlapped directionality canceling unit 5 performs a flooring process. Although in this example, the overlapped directionality canceling unit 5 performs subtraction of $N_{BD}$ from $N_{UD}$, the subtraction of $N_{UD}$ from $N_{BD}$ may be performed so that an amplitude spectrum $N_{BD1}$ of an output signal from which the overlapped component is canceled can be obtained.

Although the gain of the directionality according to frequencies due to beamformers (BFs) differs according to the intervals between microphones, let us assume that the gain correction is performed on the amplitude spectrum $N_{BD}$ of the output from the bidirectionality forming unit 3 and the amplitude spectrum $N_{UD}$ of the output from the unidirectionality forming unit 4. For example, the overlapped directionality canceling unit 5 may obtain the ratio of the amplitude spectrum according to frequencies on the basis of the amplitude spectrum $N_{BD}$ of the output from the bidirectionality forming unit 3 and the amplitude spectrum $N_{UD}$ of the output from the unidirectionality forming unit 4, which have the same time axis, and may perform the gain correction by use of a correction coefficient for making output power equal.

To the target signal extracting unit 6, an amplitude spectrum $X_{DS}$ of an output is given as the target sound from the signal adding unit 2, and the amplitude spectrum $N_{BD}$ of the output and the amplitude spectrum $N_{UD1}$ of the output obtained after the subtraction of the overlapped area are given as the non-target sound from the overlapped directionality canceling unit 5.

Then, in the target signal extracting unit 6, by subtracting, from the amplitude spectrum $X_{DS}$ of the output from the signal adding unit 2, the amplitude spectrum $N_{BD}$ of the output from the overlapped directionality canceling unit 5 and the amplitude spectrum $N_{UD1}$ of the output obtained after the subtraction of the overlapped area, an emphasized target sound is extracted.

The target signal extracting unit 6 extracts the target sound in accordance with a formula (6).

$$Y=X_{DS}-\beta_1 N_{BD}-\beta_2 N_{UD1} \tag{6}$$

Here, $\beta_1$ and $\beta_2$ are coefficients for adjusting the intensity through the spectrum subtraction.

(B-3) Effects of the First Embodiment

As described above, according to the first embodiment, by performing the SS of the non-target sound from the input signal, the non-target sound being extracted by use of sound signals picked up by the three omnidirectional microphones through the unidirectional filter and the bidirectional filter, it is possible to form a sharp directionality only in the target direction.

Further, according to the first embodiment, since only the SS is used for formation of the directionality in the target direction, even when a noise is increased, the sound source separating performance does not degrade rapidly. Furthermore, according to the first embodiment, the SS performed after canceling the directionality overlapped area in which the bidirectionality overlaps with the unidirectionality prevents degradation of the sound quality of the target sound due to plural times of subtractions of the overlapped area.

(C) Second Embodiment

Next, a second embodiment of a sound source separating apparatus and program according to an embodiment of the present invention will be described in detail with reference to appended drawings.

The first embodiment shows the case where three microphones are disposed at the vertexes of an isosceles right triangle, and the second embodiment will show a case where three microphones are disposed at the vertexes of a regular triangle.

(C-1) Configuration of the Second Embodiment

Figure 5:
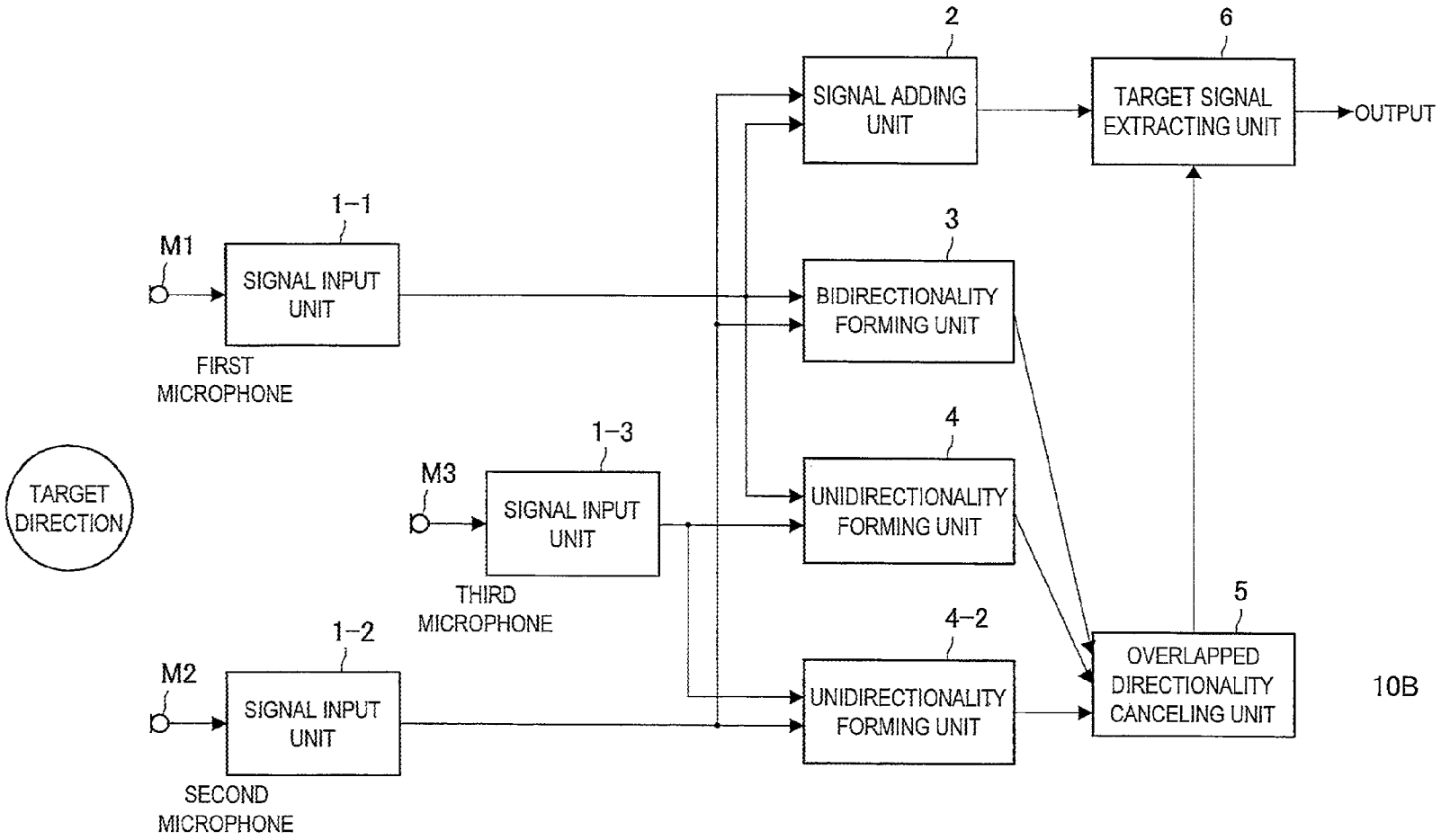
FIG. 5 is a block diagram showing a configuration of a sound source separating apparatus according to a second embodiment.

FIG. 5 is a block diagram showing a configuration of a sound source separating apparatus 10B according to the second embodiment. The same or corresponding parts as FIG. 1 according to the first embodiment are denoted by the same reference numerals.

In FIG. 5, the sound source separating apparatus 10B according to the second embodiment includes a first microphone M1, a second microphone M2, a third microphone M3, signal input units 1-1, 1-2, and 1-3, a signal adding unit 2, a bidirectionality forming unit 3, unidirectionality forming units 4 and 4-2, an overlapped directionality canceling unit 5, and a target signal extracting unit 6.

The first microphone M1 and the second microphone M2 are disposed to be horizontal with respect to the target direction. The third microphone M3 is located to be present on the same plane as the first microphone M1 and the second microphone M2, and to be opposite to the target direction. Thus, the first microphone M1, the second microphone M2, and the third microphone M3 are disposed at the vertexes of a regular triangle.

The signal input unit 1-1 is connected to the signal adding unit 2, the bidirectionality forming unit 3, and the unidirectionality forming unit 4, and gives an output signal to the signal adding unit 2, the bidirectionality forming unit 3, and the unidirectionality forming unit 4.

The signal input unit 1-2 is connected to the signal adding unit 2 and the unidirectionality forming unit 4-2, and gives an output signal to the signal adding unit 2 and the unidirectionality forming unit 4-2.

The signal input unit 1-3 is connected to the unidirectionality forming units 4 and 4-2, and gives an output signal to the unidirectionality forming units 4 and 4-2.

The unidirectionality forming unit 4 is a unidirectional filter that forms a unidirectionality having a dead angle of +60° to the target direction by use of beamformers with respect to the outputs (digital signals) from the signal input unit 1-1 and the signal input unit 1-3, and outputs the formed unidirectionality to the overlapped directionality canceling unit 5.

The unidirectionality forming unit 4-2 is a unidirectional filter that forms a unidirectionality having a dead angle of −60° to the target direction by use of beamformers with respect to the outputs (digital signals) from the signal input unit 1-2 and the signal input unit 1-3, and outputs the formed unidirectionality to the overlapped directionality canceling unit 5.

The overlapped directionality canceling unit 5 cancels a signal component that is commonly included in the outputs from the bidirectionality forming unit 3 and the unidirectionality forming units 4 and 4-2.

(C-2) Operation in the Second Embodiment

Operations of the unidirectionality forming units 4 and 4-2, the overlapped directionality canceling unit 5, and the target signal extracting unit 6 in the sound source separating apparatus 10B according to the second embodiment are different from those in the first embodiment; therefore, the operations of these structural elements will be described below.

As described above, the first microphone M1, the second microphone M2, and the third microphone M3 are disposed at the vertexes of a regular triangle.

In the second embodiment, a unidirectionality is formed on the basis of a sound signal of the first microphone M1 and the third microphone M3, and a unidirectionality is formed on the basis of a sound signal of the second microphone M2 and the third microphone M3.

In the unidirectionality forming unit 4, in accordance with the formula (1) in which $\theta_L=-\pi/2$, on the basis of a distance d (e.g., 3 cm) between the first microphone M1 and the third microphone M3, a temporal difference between a signal that has reached the first microphone M1 and a signal that has reached the third microphone M3 is calculated. Further, in the unidirectionality forming unit 4, in accordance with the formula (3), on the basis of the output signal in the frequency domain from the signal input unit 1-1 and the output signal in the frequency domain from the signal input unit 1-3, the unidirectionality having a dead angle of +60° to the target direction is formed.

In the unidirectionality forming unit 4-2, in accordance with the formula (1) in which $\theta_L=-\pi/2$, on the basis of a distance d (e.g., 3 cm) between the second microphone M2 and the third microphone M3, a temporal difference between a signal that has reached the second microphone M2 and a signal that has reached the third microphone M3 is calculated. Further, in the unidirectionality forming unit 4-2, in accordance with the formula (3), on the basis of the output signal in the frequency domain from the signal input unit 1-2 and the output signal in the frequency domain from the signal input unit 1-3, the unidirectionality having a dead angle of −60° to the target direction is formed.

In the overlapped directionality canceling unit 5, a component that is commonly included in the output from the bidirectionality forming unit 3 and the output from the unidirectionality forming units 4 and 4-2 is canceled.

Figure 6:
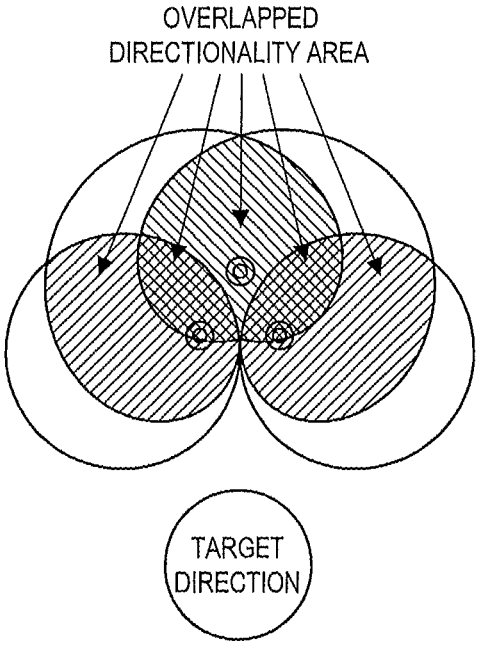
FIG. 6 shows directional characteristics formed by directional filters according to a second embodiment.

FIG. 6 shows directional characteristics formed by the directional filters according to the second embodiment.

As shown in FIG. 6, there exist overlapped directionality areas of the bidirectionality from the bidirectionality forming unit 3 and the unidirectionality from the unidirectionality forming unit 4 and of the bidirectionality from the bidirectionality forming unit 3 and the unidirectionality from the unidirectionality forming unit 4-2, and also of the unidirectionalities from the unidirectionality forming units 4 and 4-2.

The overlapped directionality canceling unit 5 cancels the overlapped areas in accordance with formulas (7) to (9) which are extended formulas of the formula (5).

$$N_{UDL1} = \begin{cases} N_{UDL} - N_{BD} \\ 0 \text{ if } N_{UDL1} < 0 \end{cases} \tag{7}$$

$$N_{UDR1} = \begin{cases} N_{UDR} - N_{BD} \\ 0 \text{ if } N_{UDR1} < 0 \end{cases} \tag{8}$$

$$N_{UDR2} = \begin{cases} N_{UDR1} - N_{UDL1} \\ 0 \text{ if } N_{UDR2} < 0 \end{cases} \tag{9}$$

Here, $N_{BD}$ is an amplitude spectrum of an output from the bidirectionality forming unit 3, $N_{UDL}$ is an amplitude spectrum of an output from the unidirectionality forming unit 4, and $N_{UDR}$ is an amplitude spectrum of an output from the unidirectionality forming unit 4-2.

In the overlapped directionality canceling unit 5, a signal component that is commonly included in an amplitude spectrum $N_{BD}$ of an output from the bidirectionality forming unit 3 and the amplitude spectrum $N_{UDL}$ of an output from the unidirectionality forming unit 4 is canceled. That is, in the overlapped directionality canceling unit 5, in accordance with the formula (7), by subtracting the amplitude spectrum $N_{BD}$ of the output from the bidirectionality forming unit 3 from the amplitude spectrum $N_{UDL}$ of the output from the unidirectionality forming unit 4, an amplitude spectrum $N_{UDL1}$ of an output obtained after the subtraction of the overlapped area is obtained.

In the overlapped directionality canceling unit 5, a signal component that is commonly included in an amplitude spectrum $N_{BD}$ of an output from the bidirectionality forming unit 3 and the amplitude spectrum $N_{UDR}$ of an output from the unidirectionality forming unit 4-2 is canceled. That is, in the overlapped directionality canceling unit 5, in accordance with the formula (8), by subtracting the amplitude spectrum $N_{BD}$ of the output from the bidirectionality forming unit 3 from the amplitude spectrum $N_{UDR}$ of the output from the unidirectionality forming unit 4-2, an amplitude spectrum $N_{UDR1}$ of an output obtained after the subtraction of the overlapped area is obtained.

Further, in the overlapped directionality canceling unit 5, a signal component that is commonly included in the amplitude spectrum $N_{UDL1}$ and the amplitude spectrum $N_{UDR1}$ is canceled, the amplitude spectrum $N_{UDL1}$ being of an output from which the component overlapped with $N_{BD}$ is canceled, the amplitude spectrum $N_{UDR1}$ being of an output from which the component overlapped with $N_{BD}$ is canceled. That is, in the overlapped directionality canceling unit 5, in accordance with the formula (9), by subtracting, from the amplitude spectrum $N_{UDR1}$ of the output from which the component overlapped with $N_{BD}$ is canceled, the amplitude spectrum $N_{UDL1}$ of the output from which the component overlapped with $N_{BD}$ is canceled, an amplitude spectrum $N_{UDR2}$ of an output obtained after the subtraction of the overlapped areas is obtained.

Further, in the formulas (7) to (9), the order of cancel of the overlapped components may be changed. That is, the amplitude spectra may be interchanged to execute the process as follows: $N_{UDL2}=N_{UDL1}-N_{UDR1}$ or $N_{BD1}=N_{BD}-N_{UDL}$.

Note that in the formulas (7) to (9), in a case where the values of the amplitude spectra $N_{UDL1}$, $N_{UDR1}$, and $N_{UDR2}$ of the outputs obtained after the subtraction of the overlapped areas are negative, a flooring process is performed in which the values of the amplitude spectra $N_{UDL1}$, $N_{UDR1}$, and $N_{UDR2}$ of the outputs obtained after the subtraction of the overlapped areas are each replaced by 0. Note that in the flooring process, the values may be replaced by the values smaller than the original values (values immediately before) of the amplitude spectra of the outputs obtained after the subtraction of the overlapped areas.

As in the first embodiment, the gain of the directionality according to frequencies due to BFs differs according to the intervals between microphones; therefore, the gain correction may be performed on each frequency for the amplitude spectra of the outputs.

To the target signal extracting unit 6, an amplitude spectrum $X_{DS}$ of the output is given as the target sound from the signal adding unit 2, and the amplitude spectrum $N_{UDL1}$ of the output and the amplitude spectrum $N_{UDR2}$ of the output which are obtained after the subtraction of the overlapped areas are given as the non-target sound from the overlapped directionality canceling unit 5.

Then, in the target signal extracting unit 6, in accordance with the formula (10), by subtracting the amplitude spectrum $N_{UDL1}$ and the amplitude spectrum $N_{UDR2}$ of the outputs obtained after the subtraction of the overlapped areas from the amplitude spectrum $X_{DS}$ of the output from the signal adding unit 2, an emphasized target sound is extracted. Here, $\beta_1$, $\beta_2$, and $\beta_3$ are coefficients for adjusting the intensity through the SS.

$$Y=X_{DS}-\beta_1 N_{BD}-\beta_2 N_{UDL1}-\beta_3 N_{UDR2} \quad (10)$$

(C-3) Effects of the Second Embodiment

As described above, according to the second embodiment, in a case where three omnidirectional microphones are disposed at the vertexes of a regular triangle, effects as in the first embodiment are obtained.

(D) Third Embodiment

Next, a third embodiment of a sound source separating apparatus and program according to an embodiment of the present invention will be described in detail with reference to appended drawings.

In the second embodiment described above, the combination of the first microphone M1 and the third microphone M3 and the combination of the second microphone M2 and the third microphone M3 each form the unidirectionality.

Here, since the sound source that is present in the target direction reach the first microphone M1 and the second microphone M2 at the same time, the output from the signal adding unit 2 can be regarded as a sound signal that is picked up by a pseudo microphone located in the intermediate point between the first microphone M1 and the second microphone M2.

Accordingly, the third embodiment will show a case where the unidirectionality having a dead angle in the target direction is formed by use of the output from the signal adding unit 2 and the output from the signal input unit 1-3.

(D-1) Configuration of the Third Embodiment

Figure 7:
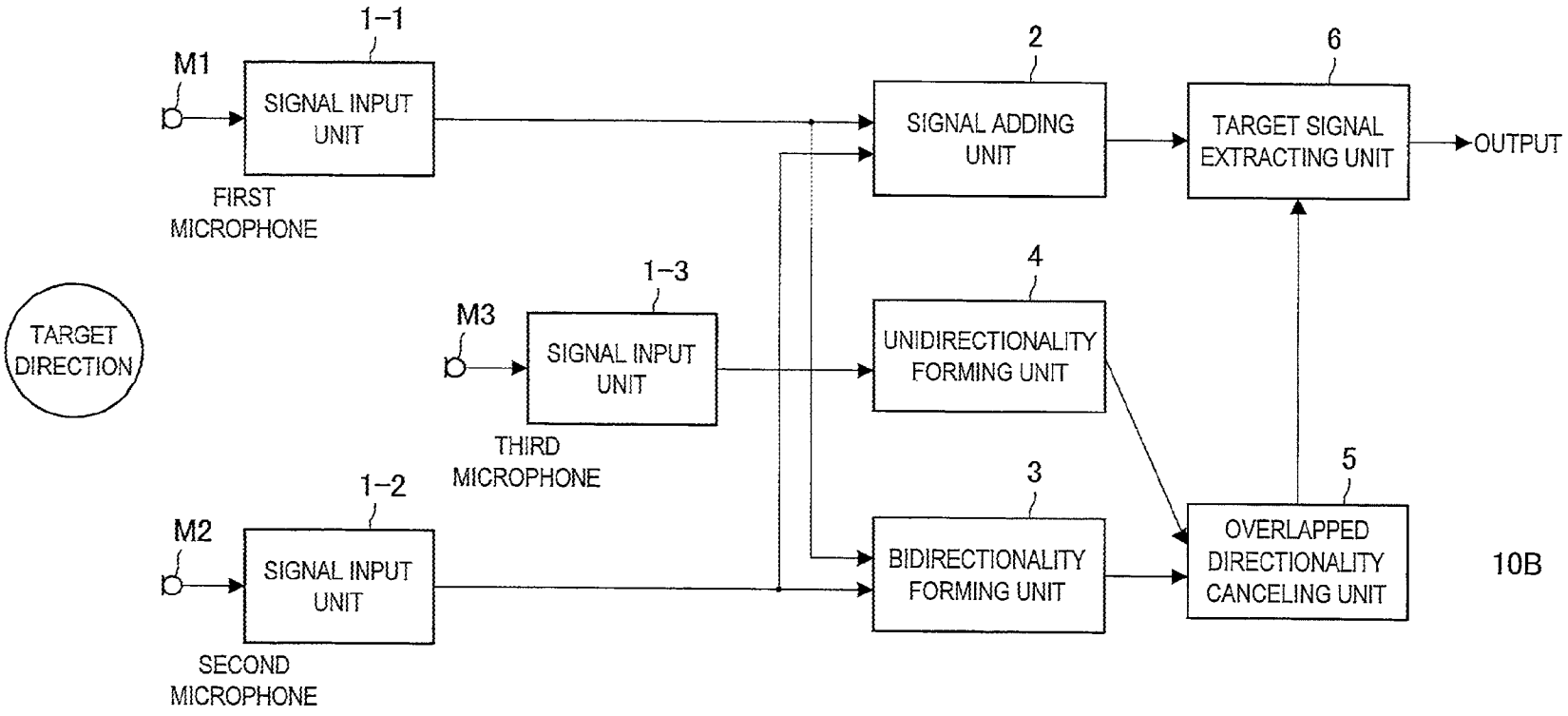
FIG. 7 is a block diagram showing a configuration of a sound source separating apparatus according to a third embodiment.

FIG. 7 is a block diagram showing a configuration of a sound source separating apparatus 10C according to the third embodiment. The same or corresponding parts as in FIG. 1 and FIG. 5 according to the first and second embodiments are denoted by the same reference numerals.

In FIG. 7, the sound source separating apparatus 10C according to the third embodiment includes a first microphone M1, a second microphone M2, a third microphone M3, signal input units 1-1, 1-2, and 1-3, a signal adding unit 2, a bidirectionality forming unit 3, a unidirectionality forming unit 4, an overlapped directionality canceling unit 5, and a target signal extracting unit 6.

The signal input unit 1-1 is connected to the signal adding unit 2 and the bidirectionality forming unit 3, and gives an output signal to the signal adding unit 2 and the bidirectionality forming unit 3, as in the first embodiment.

The signal input unit 1-2 is connected to the signal adding unit 2 and the bidirectionality forming unit 3, and gives an output signal to the signal adding unit 2 and the bidirectionality forming unit 3.

The signal input unit 1-3 is connected to the unidirectionality forming unit 4, and gives an output signal to the unidirectionality forming unit 4.

The signal adding unit 2 adds signals output from the signal input unit 1-1 and the signal input unit 1-2, as in the first embodiment, and multiplies the power of the added signal by ½, and outputs the multiplied signal to the target signal extracting unit 6 and the unidirectionality forming unit 4.

The unidirectionality forming unit 4 is a unidirectional filter that forms the unidirectionality having a dead angle in the target direction by use of beamformers with respect to the outputs from the signal input unit 1-3 and the signal adding unit 2, and outputs the formed unidirectionality to the overlapped directionality canceling unit 5.

The bidirectionality forming unit 3, the overlapped directionality canceling unit 5, and the target signal extracting unit 6 have the same configurations as those in the first embodiment.

(D-2) Operation in the Third Embodiment

The operation of the unidirectionality forming unit 4 in the sound source separating apparatus 10C according to the third embodiment are different from those in the first and second embodiments; therefore, the operation of the unidirectionality forming unit 4 will be described below.

In the signal adding unit 2, signals output from the signal input unit 1-1 and the signal input unit 1-2 are added, and a signal obtained by multiplying the power of the added signal by ½ is output to the unidirectionality forming unit 4.

Since the outputs from the signal input units 1-1 and 1-2 which are disposed to be horizontal with respect to the target direction are averaged, the output from the signal adding unit 2 can be regarded as a sound signal that is picked up by a microphone (a pseudo microphone) located in the intermediate point between the first microphone M1 and the second microphone M2.

In the unidirectionality forming unit 4, in accordance with the formula (1) in which $\theta_L=-\pi/2$, a temporal difference between the output from the third microphone M3 and the output from the signal adding unit 2 is calculated. Further, in the unidirectionality forming unit 4, in accordance with the formula (3), on the basis of the output signal in the frequency domain from the signal input unit 1-3 and the output signal in the frequency domain from the signal adding unit 2, the unidirectionality having a dead angle in the target direction is formed.

Operations of the bidirectionality forming unit 3, the overlapped directionality canceling unit 5, and the target signal extracting unit 6 are the same as those in the first embodiment, so that an emphasized target sound is extracted by the target signal extracting unit 6.

(D-3) Effects of the Third Embodiment

As described above, according to the third embodiment, even in a case where three omnidirectional microphones are disposed at the vertexes of a regular triangle, effects as in the first and second embodiments are obtained by regarding the output from the signal adding unit 2 as the sound signal picked up by the microphone located in the intermediate point between the first microphone M1 and the second microphone M2 because output signals reach the first microphone M1 and the second microphone at the same time.

(E) Fourth Embodiment

Next, a fourth embodiment of a sound source separating apparatus, sound source separating program, sound pickup apparatus, and sound pickup program according to an embodiment of the present invention will be described in detail with reference to appended drawings.

The fourth embodiment will show a case in which the present invention is applied to a sound pickup apparatus that picks up a target area sound that is present within a specific area by use of the microphone array including three omnidirectional microphones described in the first embodiment.

(E-1) Configuration of the Fourth Embodiment

Figure 8:
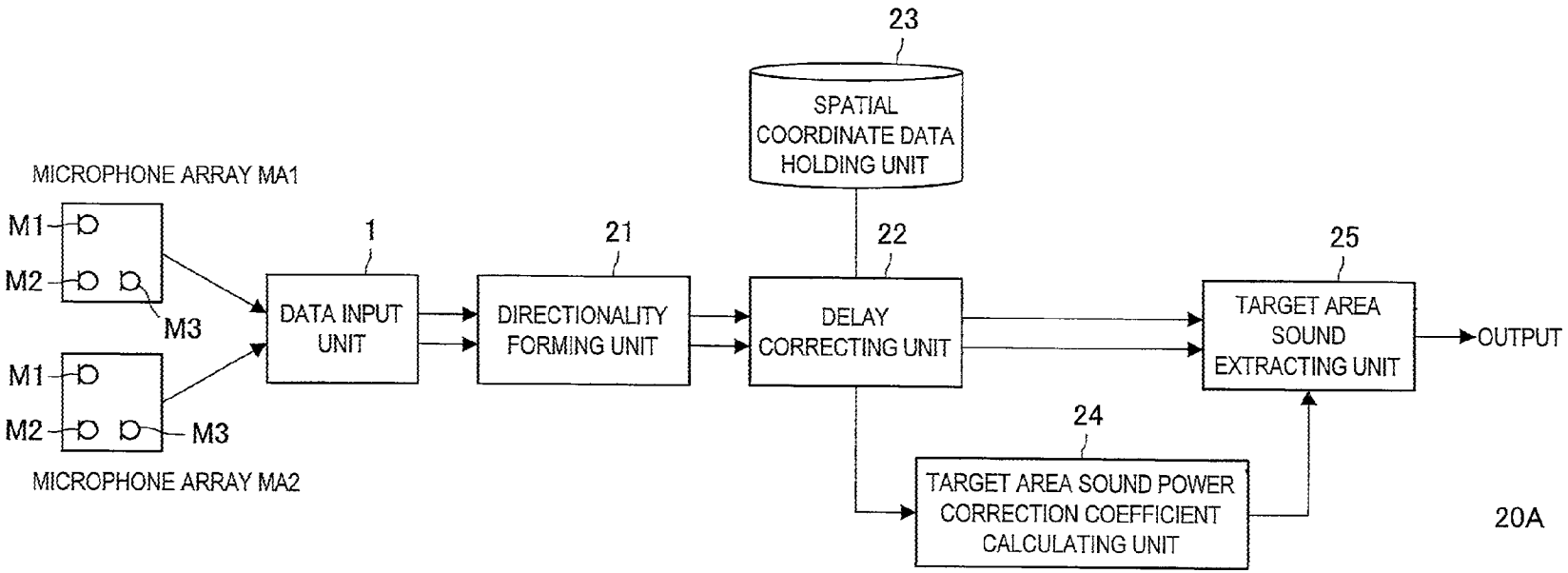
FIG. 8 is a block diagram showing a configuration of a sound pickup apparatus according to a fourth embodiment.

FIG. 8 is a block diagram showing a configuration of a sound pickup apparatus 20A according to the fourth embodiment. In FIG. 8, the same or corresponding parts as in FIG. 1 according to the first embodiment are denoted by the same reference numerals.

Portions shown in FIG. 8 other than microphones may be configured by connecting various circuits in a hardware manner, or may be configured to execute corresponding functions by causing a general device or unit including a CPU, ROM, RAM, and the like to execute a predetermined program. In a case of employing either configuration method, the functions thereof can be expressed as FIG. 8.

In FIG. 8, the sound pickup apparatus 20A according to the fourth embodiment includes a first microphone array MA1, a second microphone array MA2, a data input unit 1, a directionality forming unit 21, a delay correcting unit 22, a spatial coordinate data holding unit 23, a target area sound power correction coefficient calculating unit 24, and a target area sound extracting unit 25.

The first microphone array MA1 is disposed in a space where the target area (hereinafter also referred to as TAR, see FIG. 10) is present and in a position where the target area TAR can be directed.

As shown in FIG. 8, the first microphone array MA1 includes three microphones M1, M2, and M3. The three microphones M1, M2, and M3 are disposed at the vertexes of an isosceles right triangle. A sound signal picked up (captured) by each of the microphones M1, M2, and M3 is input to a main body of the sound pickup apparatus 20A.

In the same manner as that of the first microphone array MA1, the second microphone array MA2 has a configuration in which three microphones M1, M2, and M3 are disposed at the vertexes of an isosceles right triangle. A sound signal picked up (captured) by each of the microphones M1, M2, and M3 is input to the main body of the sound pickup apparatus 20A.

Further, the second microphone array MA2 is disposed at a position where the target area TAR can be directed, which is different from the position of the first microphone array MA1. That is, the positions of the first and second microphone arrays MA1 and MA2 may be disposed differently with respect to the target area TAR, for example, such that the first and second microphone arrays MA1 and MA2 face each other with the target area TAR interposed therebetween, as long as the directionalities of the microphone arrays MA1 and MA2 overlap with each other at least in the target area TAR.

Note that the number of microphone arrays is not limited to two. In a case where a plurality of the target areas TAR are present, the number of microphone arrays may be large enough to cover all the target areas TAR.

Further, the microphones M1, M2, and M3 included in each of the first and second microphone arrays MA1 and MA2 may be disposed at the vertexes of an isosceles right triangle or may be disposed at the vertexes of a regular triangle.

The data input unit 1 converts the sound signal picked up by the first and second microphone arrays MA1 and MA2 from an analog signal to a digital signal. The data input unit 1 converts a signal from a time domain into a frequency domain, for example, by use of fast Fourier transformation or the like, and outputs the converted signal to the directionality forming unit 21.

The directionality forming unit 22 forms a directional beam which sets the directionality toward a forward direction of each of the microphone arrays MA1 and MA2 with respect to the target area direction by use of a beamformer with respect to an output (digital signal) from each of the microphone arrays MA1 and MA2 and obtains beamformer outputs of the microphone arrays MA1 and MA2. In a technique using a beamformer, any one of various methods can be used, such as an addition type delay-and-sum method, a subtraction type spectrum-and-subtraction method, and the like. Further, the intensity of directionality may be changed in accordance with the range of the target area TAR.

The spatial coordinate data holding unit 23 holds position information of (the center of) the target area TAR and position information of each of the microphone arrays MA1 and MA2.

The delay correcting unit 22 calculates a difference of a delay (propagation delay time) generated by a difference between the distance between the target area TAR and the microphone array MA1 and the distance between the target area TAR and the microphone array MA2, and corrects at least one of beamformer outputs of the microphone arrays MA1 and MA2 so as to absorb the difference. Specifically, first, the position of the target area TAR and the position of each microphone array are acquired from the spatial coordinate data holding unit 23 and a difference in time when the target area sound reaches each microphone array (propagation delay time) is calculated. By using, as a reference, the timing at which the target area sound reaches the microphone array that is disposed at the farthest position from the target area TAR, delays are added to beamformer outputs of all the microphone arrays other than the reference microphone array so that the target area sounds can reach all the microphone arrays at the same time.

Note that in a case where the target area TAR is not changed and the distances between the target area TAR and each of the microphone arrays MA1 and MA2 are equal, the delay correcting unit 22 and the spatial coordinate data holding unit 23 can be omitted.

The target area sound power correction coefficient calculating unit 24 calculates a correction coefficient for making the power of the target area sounds at all of the beamformer outputs equal.

Here, as an example of the calculation of the correction coefficient, performed by the target area sound power correction coefficient calculating unit 24, the ratio of power of the target area sound included in the BF output from each of the microphone array may be estimated to be used as the correction coefficient.

The target area sound extracting unit 25 extracts the target area sound on the basis of each beamformer output which is output from the delay correcting unit 22 and the correction coefficient which is output from the target area sound power correction coefficient calculating unit 24.

Figure 9:
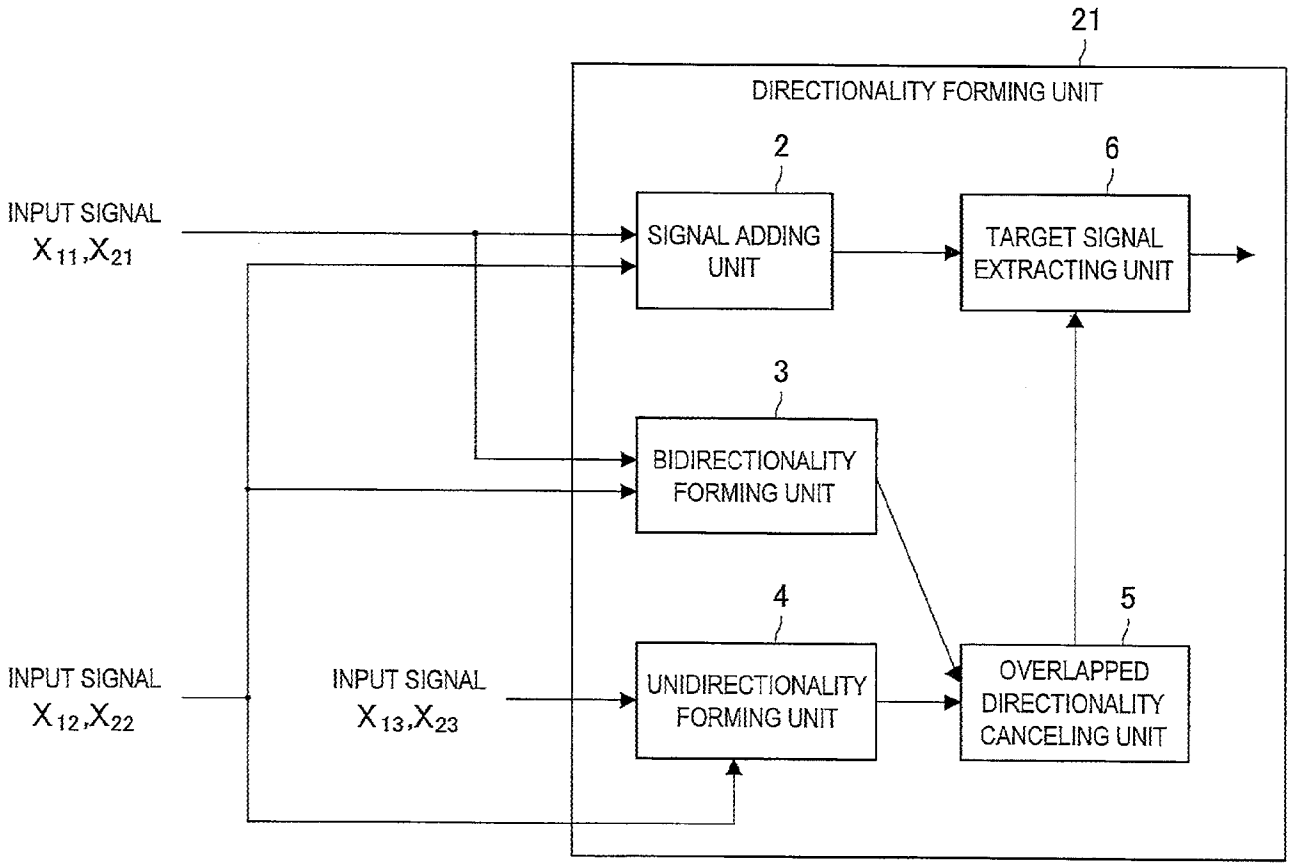
FIG. 9 is a block diagram showing a configuration of a directionality forming unit of a sound pickup apparatus according to a fourth embodiment.

FIG. 9 is a block diagram showing an internal configuration of the directionality forming unit 21 according to the fourth embodiment.

The directionality forming unit 21 has, for each of the microphone arrays MA1 and MA2, the same or corresponding configuration as in the sound source separating apparatus 10A described in the first embodiment, and the corresponding structural elements are denoted by the same reference numerals as in FIG. 1 in the first embodiment.

That is, since the directionality forming unit 21 forms directionality that has a directional direction in a forward direction of the microphone array with respect to the target direction for each of the microphone arrays MA1 and MA2, the directionality forming unit 21 has the internal configuration shown in FIG. 9 for each of the microphone arrays MA1 and MA2.

In FIG. 9, the directionality forming unit 21 according to the fourth embodiment includes a signal adding unit 2, a bidirectionality forming unit 3, a unidirectionality forming unit 4, an overlapped directionality canceling unit 5, and a target signal extracting unit 6.

(E-2) Operation in the Fourth Embodiment

Next, the operation of the sound pickup apparatus 20A according to the fourth embodiment will be described.

A sound emitted from all the sound sources located in the target area TAR is captured by all the microphones M1, M2, and M3 of the microphone arrays MA1 and MA2, which set the target area TAR as a processing target. Note that the microphones M1, M2, and M3 of the microphone arrays MA1 and MA2 also capture a sound from a sound source that is present in an area other than the target area TAR.

The sound signal (analog signal) picked up (captured) by all the microphones M1, M2, and M2 of the first microphone array MA1 is converted into a digital signal by the data input unit 1 and is given to the directionality forming unit 21. Similarly, the sound signal (analog signal) picked up (captured) by all the microphones M1, M2, and M2 of the second microphone array MA2 is converted into a digital signal by the data input unit 1 and is given to the directionality forming unit 21.

All the sound signals from the first microphone array MA1, which have been converted into digital signals, are subjected to a beamformer process performed by the directionality forming unit 21 such that the directional direction is set to a forward direction of the microphone array MA1 with respect to the direction of the target area TAR, and the beamformer output is given to the delay correcting unit 22. Further, all the sound signals from the second microphone array MA2, which have been converted into digital signals, are subjected to a beamformer process performed by the directionality forming unit 21 such that the directional direction is set to a forward direction of the microphone array MA1 with respect to the direction of the target area TAR, and the beamformer output is given to the delay correcting unit 22.

Here, a detailed operation in the directionality forming unit 21 will be described with reference to FIG. 9.

An input signal $X_{11}$ and an input signal $X_{12}$, which are output from the microphone M1 and the microphone M2, respectively, located to be horizontal with respect to the target direction, of the first microphone array MA1 are given to the signal adding unit 2. In the signal adding unit 2, after adding the input signal $X_{11}$ and the input signal $X_{12}$, the power of the added signal is multiplied by ½, so that the target sound component is emphasized.

Further, the input signals $X_{11}$ and $X_{12}$ from the microphones M1 and M2 of the first microphone array MA1 are given to the bidirectionality forming unit 3. In the bidirectionality forming unit 3, by use of the input signals $X_{11}$ and $X_{12}$, a bidirectional filter having a dead angle in the target direction is formed. As in the first embodiment, the bidirectionality is formed in accordance with the formulas (1) and (3) in which $\theta_L=0$.

Further, the input signal $X_{12}$ and an input signal $X_{13}$ from the microphones M2 and M3 of the first microphone array MA1, the microphones being located in the same direction as the target direction, are given to the unidirectionality forming unit 4. In the unidirectionality forming unit 4, by use of the input signals $X_{12}$ and $X_{13}$ which are inputs from the microphones M2 and M3 located in the same direction as the target direction, a unidirectional filter having a dead angle in the target direction is formed. As in the first embodiment, the unidirectionality is formed in accordance with the formulas (1) and (3) in which $\theta_L=-\pi/2$.

In the overlapped directionality canceling unit 5, a signal component that is commonly included in an amplitude spectrum $N_{BD}$ of an output from the bidirectionality forming unit 3 and an amplitude spectrum $N_{UD}$ of an output from the unidirectionality forming unit 4 is canceled. That is, in the overlapped directionality canceling unit 5, in accordance with the formula (5), an amplitude spectrum $N_{UD1}$ of an output obtained after subtraction of an overlapped area is obtained by subtracting the amplitude spectrum $N_{BD}$ of the output from the bidirectionality forming unit 3 from the amplitude spectrum $N_{UD}$ of an output from the unidirectionality forming unit 4.

In a case where the amplitude spectrum $N_{UD1}$ of an output obtained after the subtraction of the overlapped area is negative, a flooring process is performed in which the value of the amplitude spectrum $N_{UD1}$ of the output obtained after the subtraction of the overlapped area is replaced by 0 or a value smaller than the original value. Note that in the flooring process, the value may be replaced by a value that is smaller than the original value (value immediately before) of the amplitude spectrum $N_{UD1}$ of the output obtained after the subtraction of the overlapped area.

Although the gain of the directionality according to frequencies due to beamformers (BFs) differs according to the intervals between microphones, let us assume that the gain correction is performed on the amplitude spectrum $N_{BD}$ of the output from the bidirectionality forming unit 3 and the amplitude spectrum $N_{UD}$ of the output from the unidirectionality forming unit 4. For example, the overlapped directionality canceling unit 5 may obtain the ratio of the amplitude spectrum according to frequencies on the basis of the amplitude spectrum $N_{BD}$ of the output from the bidirectionality forming unit 3 and the amplitude spectrum $N_{UD}$ of the output from the unidirectionality forming unit 4, which have the same time axis, and may perform the gain correction by use of a correction coefficient for making the output power equal.

To the target signal extracting unit 6, an amplitude spectrum $X_{DS}$ of an output is given as the target sound from the signal adding unit 2, and the amplitude spectrum $N_{BD}$ of the output and the amplitude spectrum $N_{UD1}$ of the output obtained after the subtraction of the overlapped area are given as the non-target sound from the overlapped directionality canceling unit 5. Then, in the target signal extracting unit 6, in accordance with the formula (6), by subtracting, from the amplitude spectrum $X_{DS}$ of the output from the signal adding unit 2, the amplitude spectrum $N_{BD}$ of the output from the overlapped directionality canceling unit 5 and the amplitude spectrum $N_{UD1}$ of the output obtained after the subtraction of the overlapped area, an emphasized target sound is extracted.

As for the second microphone array MA2, input signals $X_{21}$, $X_{22}$, and $X_{23}$ from the microphones M1, M2, and M3 are given to the directionality forming unit 21, and in the same manner as that in the case of the first microphone array MA1, an emphasized target sound is extracted only to a forward direction of the second microphone array MA2 with respect to the target direction.

In the delay correcting unit 3, on the basis of data held by the spatial coordinate data holding unit 23, a difference between a propagation delay time from the target area TAR to the first microphone array MA1 and a propagation delay time from the target area TAR to the second microphone array MA2, the difference being generated by the difference between the distance between the target area TAR and the microphone array MA1 and the distance between the target area TAR and the microphone array MA2, is calculated, and at least one of time axes of beamformer outputs $X_{ma1}(t)$ and $X_{ma1}(t-\tau)$ for each of the microphone arrays MA1 and MA2 is corrected so as to absorb the temporal difference.

In the above manner, the beamformer outputs $X_{ma1}(t)$ and $X_{ma1}(t-\tau)$ having the same time axis are given to the target area sound extracting unit 25 and the target area sound power correction coefficient calculating unit 24.

Further, in the target area sound power correction coefficient calculating unit 24, on the basis of the beamformer outputs $X_{ma1}(t)$ and $X_{ma1}(t-\tau)$ having the same time axis, a correction coefficient for making the power of the target area sounds equal in the beamformer outputs $X_{ma1}(t)$ and $X_{ma1}(t-\tau)$ is calculated.

In a case of using two microphone arrays MA1 and MA2, for example, the correction coefficient of the target area sound power is calculated using formulas (11) and (12) or formulas (13) and (14).

$$\alpha_1(n) = \mathrm{mode}\left(\frac{X_{2k}(n)}{X_{1k}(n)}\right) \quad k = 1, 2, \ldots, N \tag{11}$$

$$\alpha_2(n) = \mathrm{mode}\left(\frac{X_{1k}(n)}{X_{2k}(n)}\right) \quad k = 1, 2, \ldots, N \tag{12}$$

$$\alpha_1(n) = \mathrm{median}\left(\frac{X_{2k}(n)}{X_{1k}(n)}\right) \quad k = 1, 2, \ldots, N \tag{13}$$

$$\alpha_2(n) = \mathrm{median}\left(\frac{X_{1k}(n)}{X_{2k}(n)}\right) \quad k = 1, 2, \ldots, N \tag{14}$$

Here, $X_{1k}(n)$ and $X_{2k}(n)$ represent amplitude spectra of the beamformer outputs from the microphone arrays MA1 and MA2, N represents the total number of frequency bins, k represents a frequency, and $\alpha_1(n)$ and $\alpha_2(n)$ represent power correction coefficients with respect to each of the beamformer outputs.

The target area sound extracting unit 25 performs a spectral subtraction of each beamformer output data that has been corrected by any one of the correction coefficients $\alpha_1(n)$ and $\alpha_2(n)$ from the target area sound power correction coefficient calculating unit 24, in accordance with the formulas (15) and (16), and extracts noise that is present in the target area direction. That is, each beamformer output is corrected by any one of the correction coefficients $\alpha_1(n)$ and $\alpha_2(n)$, and the spectral subtraction is performed, thereby extracting the non-target area sound that is present in the target area direction.

$$N_1(n)=X_1(n)-\alpha_2(n)X_2(n) \tag{15}$$

$$N_2(n)=X_2(n)-\alpha_1(n)X_1(n) \tag{16}$$

In order to extract a non-target area sound $N_1(n)$ that is present in the target area direction when seen from the microphone array MA1, as shown in the formula (15), a spectral subtraction, from the beamformer output $X_1(n)$ of the microphone array MA1, of a value obtained by multiplying the beamformer output $X_2(n)$ from the microphone array MA2 by the power correction coefficient $\alpha_2$ is performed. Similarly, a non-target area sound $N_2(n)$ that is present in the target area direction when seen from the microphone array MA2 is extracted in accordance with the formula (16).

Further, the target area sound extracting unit 25 performs a spectral subtraction of the extracted noise from each beamformer output in accordance with formulas (17) and (18), thereby extracting the target area sound. Here, $\gamma_1(n)$ and $\gamma_2(n)$ are coefficients for changing the intensity at the time of the spectral subtraction.

$$Y_1(n)=X_1(n)-\gamma_1(n)N_1(n) \tag{17}$$

$$Y_2(n)=X_2(n)-\gamma_2(n)N_2(n) \tag{18}$$

Figure 10:
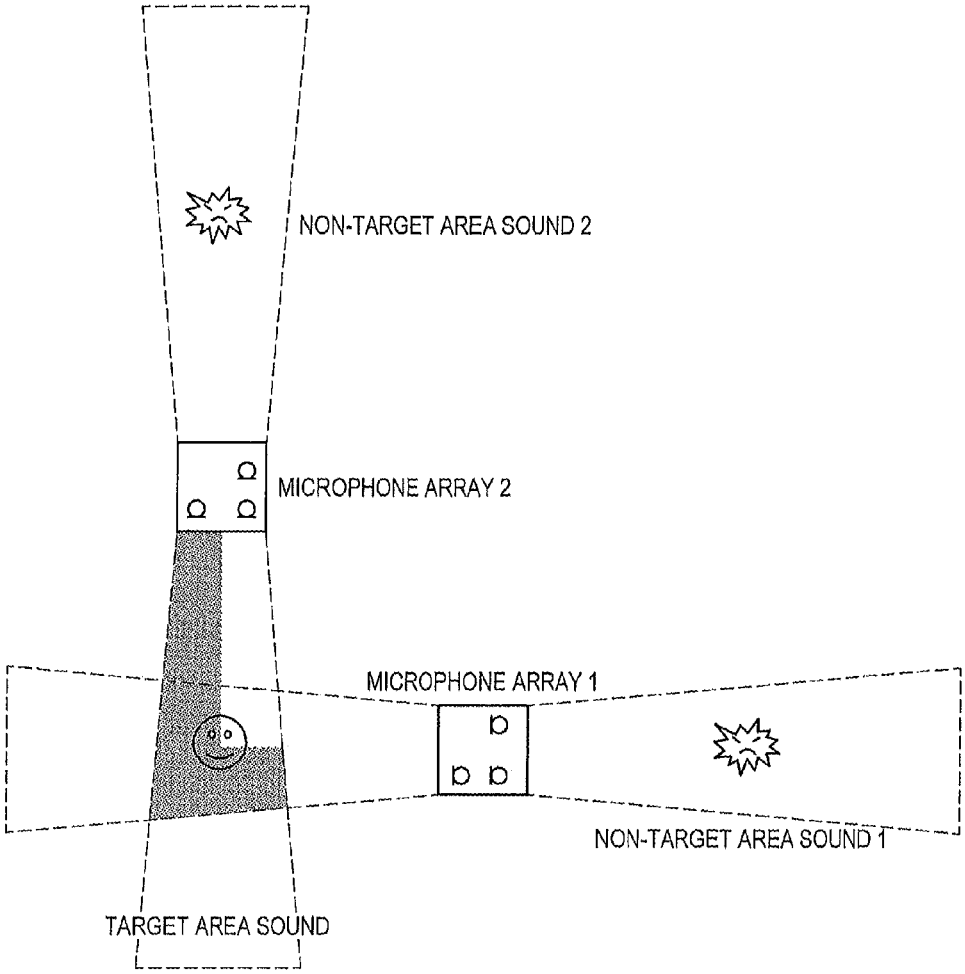
FIG. 10 shows an image of sound pickup in an area performed by a sound pickup apparatus according to a fourth embodiment.

FIG. 10 shows an image of sound pickup in an area performed by the sound pickup apparatus 20A according to the fourth embodiment. A dotted line in FIG. 10 represents the directionality of a conventional subtraction-type BF using bidirectionality, the BF being proposed in Japanese Application Number 2012-217315, and a painted portion represents the directionality obtained by the technique according to the fourth embodiment.

As shown in FIG. 10, in each of the microphone arrays MA1 and MA2, the microphones M1 and M2 are disposed to be horizontal with respect to the target direction, and the microphone M3 is disposed on a straight line that intersects with a straight line connecting the microphone M1 and M2 and passes through any of the microphones (here, the microphone M2).

Since the directionality of each of the microphone arrays MA1 and MA2 is formed only in the forward direction, an effect of reverberation from the backward direction can be suppressed. Further, by suppressing non-target area sounds 1 and 2 located in the backward direction of each of the microphone arrays MA1 and MA2 beforehand, the non-target area sounds being denoted by the dotted line in FIG. 10, the SN ratio of picking up a sound in an area can be improved.

A conventional area-sound pickup technique requires the directionalities of the microphone arrays MA1 and MA2 to overlap with each other only in the target area. Therefore, as shown in FIG. 10, indeed the conventional bidirectional subtraction-type BF can form a sharp directionality in the target direction, but a straight directionality is formed not only in the forward direction, but also in the backward direction, of the microphone arrays MA1 and MA2 with respect to the target direction. Accordingly, even when a sound is to be picked up in an area between the two microphone arrays MA1 and MA2, all the directionalities of the microphone arrays MA1 and MA2 overlap with each other, resulting in a sound pickup of all the areas that are present on the straight line connecting the two microphone arrays MA1 and MA2.

However, in a case of the fourth embodiment, the directionalities of the microphone arrays MA1 and MA2 are formed only in the forward direction of the target area TAR; thus, it is possible to pick up a sound in an area between the two microphone arrays MA1 and MA2.

Figure 11:
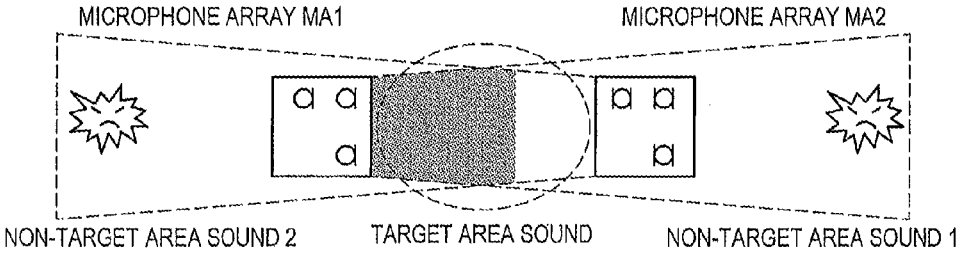
FIG. 11 shows another image of sound pickup in an area performed by a sound pickup apparatus according to a fourth embodiment.

FIG. 11 shows another image of sound pickup in an area performed by the sound pickup apparatus 20A according to the fourth embodiment. In FIG. 11, the two microphone arrays MA1 and MA2 are disposed to face each other with the target area TAR interposed therebetween.

In this case, when the directionalities of the two microphone arrays MA1 and MA2 are formed, the directionality of the microphone array MA1 includes the target area sound and a non-target area sound 2.

Further, the directionality of the microphone array MA2 includes the target area sound and a non-target area sound 1.

Since the non-target area sound components included in the directionalities are different, only the target area sound that is commonly included therein can be extracted. An area-sound pickup with the microphone arrays MA1 and MA2 disposed in this manner, can further suppress the effects of reverberation.

That is, in a case where the area-sound pickup is performed by use of the two microphone arrays MA1 and MA2, in the conventional area-sound technique proposed in Japanese Application Number 2012-217315, the angle made by the directionalities of the microphone arrays MA1 and MA2 is 90°, while it is 180° according to the fourth embodiment. Accordingly, the reflected non-target area sound is less likely to be mixed into the directionalities of the microphone arrays MA1 and MA2 at the same time, and the area-sound pickup performance is less likely to degrade.

(E-3) Effects of the Fourth Embodiment

As described above, according to the fourth embodiment, by use of a microphone array including three omnidirectional microphones, the directionality is formed only in the forward direction of the target area, and the area-sound pickup can suppress the effects of reverberation and improve the SN ratio.

(F) Fifth Embodiment

Next, a fifth embodiment of a sound source separating apparatus, sound source separating program, sound pickup apparatus, and sound pickup program according to an embodiment of the present invention will be described in detail with reference to appended drawing.

In a case of using microphone arrays each including three microphones, a change in combination of the microphones that form the bidirectionality or the unidirectionality can change the direction in which the directionality is formed.

Accordingly, in the fifth embodiment, an embodiment will be shown in which a change in the directional direction of each microphone array enables sound pickup of another area without moving the microphone arrays.

(F-1) Configuration of the Fifth Embodiment

Figure 12:
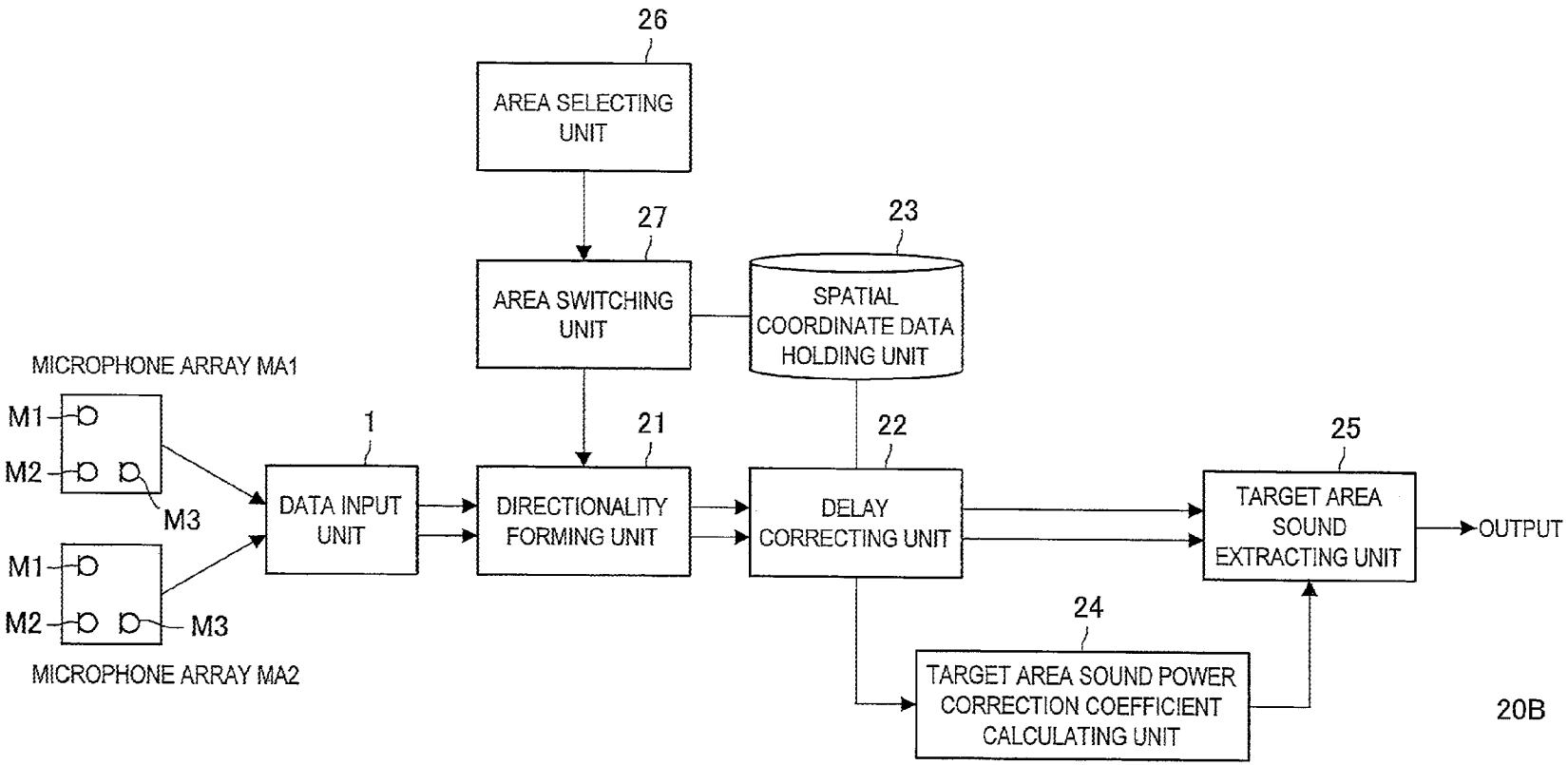
FIG. 12 is a block diagram showing a configuration of a sound pickup apparatus according to a fifth embodiment.

FIG. 12 is a block diagram showing a configuration of a sound pickup apparatus 20B according to the fifth embodiment. The same or corresponding parts as in FIG. 8 according to the fourth embodiment are denoted by the same reference numerals.

In FIG. 12, the sound pickup apparatus 20B according to the fifth embodiment includes a first microphone array MA1, a second microphone array MA2, a data input unit 1, a directionality forming unit 21, a delay correcting unit 22, a spatial coordinate data holding unit 23, a target area sound power correction coefficient calculating unit 24, and a target area sound extracting unit 25, and in addition, an area selecting unit 26 and an area switching unit 27.

The area selecting unit 26 receives information on the target area TAR that is selected by a user through a GUI, for example, and gives the information to the area switching unit 8. The number of the target areas TAR is not limited to one, and a plurality of the target areas can be selected at the same time.

On the basis of the information of the target area TAR given from the area selecting unit 26, the area switching unit 27 acquires position information of the target area TAR, each of the microphone arrays MA1 and MA2, and the microphones M1, M2, and M3 included in each of the microphone arrays MA1 and MA2, from the spatial coordinate data holding unit 23, determines combination of microphone arrays and microphones that are necessary for forming the directionality toward the target area TAR, and controls a signal to be input to the directionality forming unit 21.

(F-2) Operation in the Fifth Embodiment

Operations of the area selecting unit 26 and the area switching unit 27 in the operation of the sound pickup apparatus 20B according to the fifth embodiment are different from those in the sound pickup apparatus 20A according to the fourth embodiment; therefore, the operations of the area selecting unit 26 and the area switching unit 27 will be described in detail.

The area selecting unit 26 receives information on one or more target areas TAR that are selected by the user through a GUI, for example, and transmits the information to the area switching unit 27.

In the area switching unit 27, on the basis of the information on the target area transmitted from the area selecting unit 26, position information of the target area TAR selected from the spatial coordinate data holding unit 23, position information of each of the microphone arrays MA1 and MA2, and position information of the microphones M1, M2, and M3 included in each of the microphone arrays are acquired. Further, the area switching unit 27 determines combination of microphone arrays and microphones that are necessary for forming the directionality toward the target area, and controls a signal to be input to the directionality forming unit 21.

Figure 13:
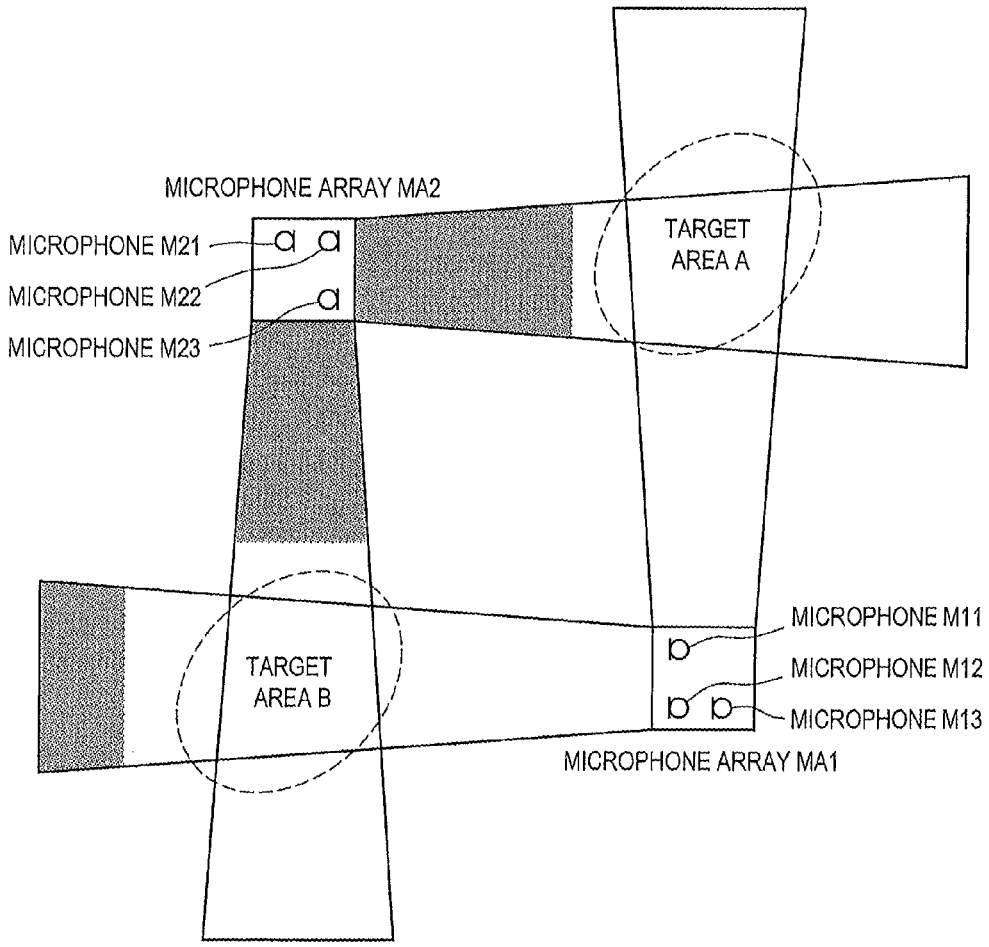
FIG. 13 shows an example of an image of a situation in which, by use of two microphone arrays each including three microphones according to a fifth embodiment, two areas are switched to pick up a sound.

FIG. 13 shows an example of an image of a situation in which, by use of two microphone arrays MA1 and MA2, each including three microphones according to the fifth embodiment, two areas are switched to pick up a sound.

The microphone array MA1 includes microphones M11, M12, and M13, and the microphone array MA2 includes microphones M21, M22, and M23.

For example, when a target area A is selected by the user, selection information of the target area A is given from the area selecting unit 26 to the area switching unit 27. The area switching unit 27 acquires position information of the selected target area A from the spatial coordinate data holding unit 23.

In this case, the microphone arrays MA1 and MA2 which can form the directionality in the target area A are selected from the area selecting unit 26, and position information of the microphone arrays MA1 and MA2 and position information of the microphones M11, M12, and M13 of the microphone array MA1 and of the microphones M21, M22, and M23 of the microphone array MA2 are acquired from the spatial coordinate data holding unit 23. As a selection method of the microphone arrays MA1 and MA2, for example, in a case where a plurality of microphone arrays are disposed, given two microphone arrays MA1 and MA2 may be selected or the microphone arrays MA1 and MA2 which can form the directionality according to the target area may be determined beforehand.

Next, the area switching unit 27 controls input signals to the directionality forming unit 21 such that the bidirectionality is formed by combination of the microphones M12 and M13 of the microphone array MA1 and the microphones M22 and M23 of the microphone array MA2 and the unidirectionality is formed by combination of the microphones M11 and M12 of the microphone array MA1 and the microphones M21 and M22 of the microphone array MA2.

In accordance with an instruction from the area switching unit 27, the directionality forming unit 21 inputs the input signals from the data input unit 1 to the bidirectionality forming unit 3 and the unidirectionality forming unit 4, thereby forming the bidirectionality and the unidirectionality.

Meanwhile, in a case where a target area B is selected, the area switching unit 27 controls input signals to the directionality forming unit 21 such that the bidirectionality is formed by combination of the microphones M11 and M12 of the microphone array MA1 and the microphones M21 and M22 of the microphone array MA2 and the unidirectionality is formed by combination of the microphones M12 and M13 of the microphone array MA1 and the microphones M22 and M23 of the microphone array MA2, thereby switching the sound pickup area. Also in this case, the directionality forming unit 21 inputs the input signals from the data input unit 1 to the bidirectionality forming unit 3 and the unidirectionality forming unit 4 in accordance with an instruction from the area switching unit 27, thereby forming the bidirectionality and the unidirectionality.

Further, in a case where the target area A and the target area B are selected at the same time as the target area, the area switching unit 27 makes instructions by selecting combination of microphone arrays and microphones in parallel for each of the selected target areas. Thus, the bidirectionality and the unidirectionality for each of the selected target areas can be formed.

(F-3) Effects of the Fifth Embodiment

As described above, according to the fifth embodiment, in addition to the effects of the fourth embodiment, by changing the directional direction of each microphone array, it is possible to pick up a sound in another area without moving the microphone arrays.

(G) Other Embodiments

Although a variety of modified embodiments are described in the above embodiments, the following modified embodiments can be further given.

Each of the above-described embodiments is made by including the signal adding unit 2; however, the signal adding unit 2 may be omitted in a case where the input signal to be given to the target signal extracting unit 6 is used as a signal captured by the microphone M1 or M2.

Although the fourth and fifth embodiments show cases where the microphone array in which three microphones are disposed at the vertexes of an isosceles right triangle is used, a microphone array in which three microphones are disposed at the vertexes of a regular triangle may be used. In this case, the directionality forming unit 21 includes the signal adding unit 2, the bidirectionality forming unit 3, the unidirectionality forming unit 4 (4 and 4-2), the overlapped directionality canceling unit 5, and the target signal extracting unit 6, which are described in the second or third embodiment, and the target signal may be extracted through the operations described in the second or third embodiment.

Although the fourth and fifth embodiments show two microphone arrays, three or more microphone arrays may be used. For example, in a case where three microphones are used, the target area sound may be determined from three target area sounds in total, which are the target area sound obtained from first and second microphone arrays by the method shown in the fourth and fifth embodiments and the target area sounds obtained from the second microphone array and a third microphone array by the method shown in each of the embodiments.

In each of the above embodiments, the sound signal captured by the microphone is processed in real time; however, the sound signal captured by the microphone may be stored in a storage medium and is then read out from the storage medium to be processed, thereby obtaining the emphasized signal of the target sound or the target area sound. In a case where a storage medium is used in this manner, the position where the microphone is set may be away from the position where the process of extracting the target sound or the target area sound is performed. Similarly, even in a case where the process is performed in real time, the position where the microphone is set may be away from the position where the process of extracting the target sound or the target area sound is performed, and a signal may be supplied to a remote area by communication.

The case where the above-described storage medium or communication is used is also included in the concept of the sound pickup apparatus according to an embodiment of the present invention.

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

What is claimed is:

1. A sound pickup apparatus comprising:

a plurality of microphone arrays each including three microphones disposed at vertexes of an isosceles right triangle or a regular triangle;

a directionality forming unit configured to form directionality, for each of the microphone arrays, only in a forward direction of each of the microphone arrays with respect to a target area by use of beamformers, for each output from each of the microphone arrays, the directionality forming unit comprising:

a bidirectionality forming unit configured to form a bidirectionality having a dead angle in a target direction by use of a sound signal picked up by two microphones which are located to be horizontal with respect to the target direction, among three microphones disposed at vertexes of an isosceles right triangle;

a unidirectionality forming unit configured to form a unidirectionality having a dead angle in the target direction by use of a sound signal picked up by two microphones which are located in a same direction as the target direction, among the three microphones; and a target sound extracting unit configured to extract a target sound by performing a spectral subtraction of all outputs from the bidirectionality forming unit and the unidirectionality forming unit from either one of sound signals picked up by the two microphones located to be horizontal with respect to the target direction or a signal obtained by averaged sound signals picked up by the two microphones;

a power correction coefficient calculating unit configured to calculate, a ratio of amplitude spectra of beamformer outputs between outputs for each of the microphone arrays from the directionality forming unit and set a mode or a median of the calculated ratio of amplitude spectra as a correction coefficient which corrects power of beamformer outputs for each of the microphone arrays; and a target area sound extracting unit configured to extract a target area sound by performing the following processes in sequence:

correcting a beamformer output from each of the microphone arrays from the directionality forming unit by use of the correction coefficient calculated by the power correction coefficient calculating unit, performing a spectral subtraction of the beamformer output from each of the microphone arrays, the beamformer output being obtained by the correction, to extract a non-target area sound which is present in the target area direction when seen from each of the microphone arrays, and performing a spectral subtraction of the extracted non-target area sound from the beamformer output from each of the microphone arrays from the directionality forming unit.

2. The sound pickup apparatus according to claim 1, further comprising:

a spatial coordinate data holding unit configured to hold position information of the target area, each of the microphone arrays, and the microphones included in each of the microphone arrays;

an area acquiring unit configured to acquire information related to selected one or more target areas; and an area switching unit configured to perform the following:

acquire, on the basis of information related to the one or more target areas from the area acquiring unit, the position information of the target area, each of the microphone arrays, and the microphones included in each of the microphone arrays from the spatial coordinate data holding unit, determine combination of the microphone arrays for forming directionality toward the selected one or more target areas and combination of the microphones which form a bidirectionality and a unidirectionality in the microphone arrays, and control a signal to be input to the directionality forming unit.

3. The sound pickup apparatus according to claim 1, further comprising:

a delay correcting unit configured to perform a correction process that absorbs a difference in propagation delay times of the target area sound to the microphone arrays between outputs of the microphone arrays from the directionality forming unit.

4. A method of picking up sound in a computer system including a plurality of microphone arrays each including three microphones disposed at vertexes of a triangle, comprising:

forming, by a directionality forming unit, directionality only in a forward direction of each of the microphone arrays with respect to a target area by use of beamformers for each output from each of the microphone arrays;

forming, by the bidirectionally forming unit, a bidirectionality having a dead angle in a target direction by use of a sound signal picked up by two microphones which are located to be horizontal with respect to the target direction, among three microphones disposed at vertexes of an isosceles right triangle;

forming, by a unidirectionality forming unit, a unidirectionality having a dead angle in the target direction by use of a sound signal picked up by two microphones which are located in a same direction as the target direction, among the three microphones;

extracting a target sound by performing a spectral subtraction of all outputs from the bidirectionality forming unit and the unidirectionality forming unit from either one of sound signals picked up by the two microphones located to be horizontal with respect to the target direction or a signal obtained by averaged sound signals picked up by the two microphones;

calculating, by a power correction coefficient calculating unit, a ratio of amplitude spectra of beamformer outputs between outputs for each of the microphone arrays from the directionality forming unit;

setting a mode or a median of the calculated ratio of amplitude spectra as a correction coefficient which corrects power of beamformer outputs for each of the microphone arrays; and extracting, by a target area sound extracting unit, a target area sound by performing the following processes in sequence:

correcting a beamformer output from each of the microphone arrays from the directionality forming unit by use of the correction coefficient calculated by the power correction coefficient calculating unit, performing a spectral subtraction of the beamformer output from each of the microphone arrays, the beamformer output being obtained by the correction, to extract a non-target area sound which is present in the target area direction when seen from each of the microphone arrays, and performing a spectral subtraction of the extracted non-target area sound from the beamformer output from each of the microphone arrays from the directionality forming unit.

* * * * *